US006739526B2

(12) United States Patent
Wlodarczyk

(10) Patent No.: US 6,739,526 B2
(45) Date of Patent: May 25, 2004

(54) SPRAY BAR ASSEMBLY

(75) Inventor: James T. Wlodarczyk, Chicago, IL (US)

(73) Assignee: Thomas Engineering, Inc., Hoffman Estates, IL (US)

( * ) Notice: Subject to any disclaimer, the term of this patent is extended or adjusted under 35 U.S.C. 154(b) by 201 days.

(21) Appl. No.: 10/097,443

(22) Filed: Mar. 14, 2002

(65) Prior Publication Data

US 2002/0139300 A1 Oct. 3, 2002

Related U.S. Application Data

(60) Provisional application No. 60/275,921, filed on Mar. 15, 2001.

(51) Int. Cl.[7] ..... B05B 1/14; B05B 1/20; A62C 37/20

(52) U.S. Cl. ..... 239/551; 239/159; 239/162; 239/170; 239/127; 239/290; 239/562; 239/566; 118/302; 118/323

(58) Field of Search ..... 239/159, 162, 239/170, 127, 264, 290, 296, 550, 551, 562, 566, 548, 727, 754; 118/302, 323

(56) References Cited

U.S. PATENT DOCUMENTS 3,044,264 A * 7/1962 Seaward et al. ..... 239/550
3,301,488 A * 1/1967 Norris ..... 239/290
3,599,866 A * 8/1971 Bolton ..... 239/127
4,760,961 A * 8/1988 Nagai ..... 239/562
4,960,242 A * 10/1990 Larson ..... 239/170

* cited by examiner

*Primary Examiner*—Robin O. Evans
(74) *Attorney, Agent, or Firm*—Pauley Petersen & Erickson

(57) ABSTRACT

A coating apparatus for coating a material to be coated with a solution is disclosed, preferably for coating pharmaceuticals. A spray bar having a spray gun receptacle, a solution inlet conduit and an atomizing air conduit is disclosed. The spray gun is positionable in the spray gun receptacle and has a body portion adapted to fit in the receptacle and an insertion portion having a sealable orifice at a spraying end thereof. The body portion has an internal void constructed and arranged to be in fluid communication with the solution inlet conduit and the atomizing air conduit when the spray gun is positioned in the spray gun receptacle and the insertion portion is in an open position. The insertion portion is moveable between an open position defining a passage between the body portion void and the spraying end orifice a closed position sealing the insertion portion against the body portion to close said passage.

9 Claims, 24 Drawing Sheets

SPRAY BAR ASSEMBLY

This application claims the benefit of Provisional Application Ser. No. 6/275,921 filed Mar. 15, 2001.

BACKGROUND OF THE INVENTION

1. Field of the Invention

This invention relates to a coating apparatus and method for coating a material to be coated with a solution or a suspension. In a specific embodiment, the apparatus and method are applicable in the pharmaceutical industry for coating tablets or beads. A spray bar having a spray gun receptacle, a solution inlet conduit and an atomizing air conduit is disclosed. The spray gun is positionable in the spray gun receptacle and has a body portion adapted to fit in the receptacle and an insertion portion having a sealable orifice at a spraying end thereof. The body portion has an internal void constructed and arranged to be in fluid communication with the solution inlet conduit and the atomizing air conduit when the spray gun is positioned in the spray gun receptacle and the insertion portion is in an open position. The insertion portion is moveable between an open position defining a passage between the body portion void and the spraying end orifice a closed position sealing the insertion portion against the body portion to close said passage.

2. Description of Prior Art

In the past, apparatus for coating pharmaceuticals and other coating equipment were expensive, complex, difficult to clean and came with a multiplicity of parts. With each of these apparatus, complex equipment is required. The apparatus of the prior art are inherently expensive, difficult to operate properly, and difficult to maintain.

Thus, a problem associated with coating apparatus for coating a material to be coated with a solution that precede the present invention is that they require complex apparatus that are not easily maintained in the field.

Another problem associated with coating apparatus for coating a material to be coated with a solution that precede the present invention is that they require the use of equipment that are not easily cleaned.

Yet a further problem associated with coating apparatus for coating a material to be coated with a solution that precede the present invention is that they require many parts.

Still another problem associated with coating apparatus for coating a material to be coated with a solution that precede the present invention is that they cannot be disassembled quickly without the use of hand tools or other tools.

Yet a further problem associated with coating apparatus for coating a material to be coated with a solution that precede the present invention is that they are not readily compliant with Current Good Manufacturing Practices ("GCMP") as set forth by the Food and Drug Administration ("FDA").

Still a further problem associated with coating apparatus for coating a material to be coated with a solution that precede the present invention is that they cannot be readily adapted to a multiple-gun application facilitating a more uniform coating application without complicating the structure and maintenance of the equipment.

Still a further problem associated with coating apparatus for coating a material to be coated with a solution that precede the present invention is that they cannot be readily disassembled and reassembled with repeatable results.

Yet a further problem associated with coating apparatus for coating a material to be coated with a solution that precede the present invention is that they foul with product build-up and tend to disrupt the coating process, adversely affecting product quality and thereby leading to disqualified or discarded batches.

For the foregoing reasons, there has been defined a long felt and unsolved need for a coating apparatus for coating a material to be coated with a solution that is easily installed, comparatively inexpensive to manufacture and maintain and adjustable to accommodate a variety of applications. In contrast to the foregoing, the present invention constitutes a coating apparatus for coating a material to be coated with a solution that seeks to overcome the problem discussed above while at the same time providing a simple relatively easily constructed apparatus and method that is readily adapted to a variety of applications.

SUMMARY OF THE INVENTION

It is an object of the present invention to provide a coating apparatus for coating a material to be coated with a solution that does not require complex apparatus that are not easily maintained in the field.

Yet another object of the present invention is to provide a coating apparatus for coating a material to be coated with a solution that permits use of equipment that is easily cleaned.

Still a further object of the present invention is to provide a coating apparatus for coating a material to be coated with a solution that utilizes fewer parts.

It is another of the present invention to provide a coating apparatus for coating a material to be coated with a solution that can be disassembled quickly without the use of hand tools or other tools.

Still a further object of the present invention is to provide a coating apparatus for coating a material to be coated with a solution that readily complies with Current Good Manufacturing Practices ("GCMP") as set forth by the Food and Drug Administration ("FDA").

An even further object of the present invention is to provide a coating apparatus for coating a material to be coated with a solution that can be readily adapted to a multiple-gun application facilitating a more uniform coating application without complicating the structure and maintenance of the equipment.

Still another object of the present invention is to provide a coating apparatus for coating a material to be coated with a solution that can be readily disassembled and reassembled with repeatable results.

Yet another object of the present invention is to provide a coating apparatus for coating a material to be coated with a solution that will not foul with product build-up and disrupt the coating process, thereby improving product quality and leading to fewer disqualified or discarded batches.

For the foregoing reasons, there has been defined a long felt and unsolved need for a coating apparatus for coating a material to be coated with a solution that is easily installed, comparatively inexpensive to manufacture and maintain and adjustable to accommodate a variety of applications. In contrast to the foregoing, the present invention constitutes a coating apparatus for coating a material to be coated with a solution that seeks to overcome the problem discussed above while at the same time providing a simple relatively easily constructed apparatus and method that is readily adapted to a variety of applications.

Thus, the present invention discloses a design and method for a coating apparatus for coating a material to be coated with a solution is disclosed, preferably for coating pharmaceuticals. A spray bar having a spray gun receptacle, a solution inlet conduit and an atomizing air conduit is disclosed. The spray gun is positionable in the spray gun receptacle and has a body portion adapted to fit in the receptacle and an insertion portion having a sealable orifice at a spraying end thereof. The body portion has an internal void constructed and arranged to be in fluid communication with the solution inlet conduit and the atomizing air conduit when the spray gun is positioned in the spray gun receptacle and the insertion portion is in an open position. The insertion portion is moveable between an open position defining a passage between the body portion void and the spraying end orifice a closed position sealing the insertion portion against the body portion to close said passage.

These and other objects, advantages and features of the present invention will be apparent from the detailed description that follows.

BRIEF DESCRIPTION OF THE DRAWINGS

In the detailed description that follows, reference will be made to the following figures.

DETAILED DESCRIPTION OF PREFERRED EMBODIMENTS

Figure 1:
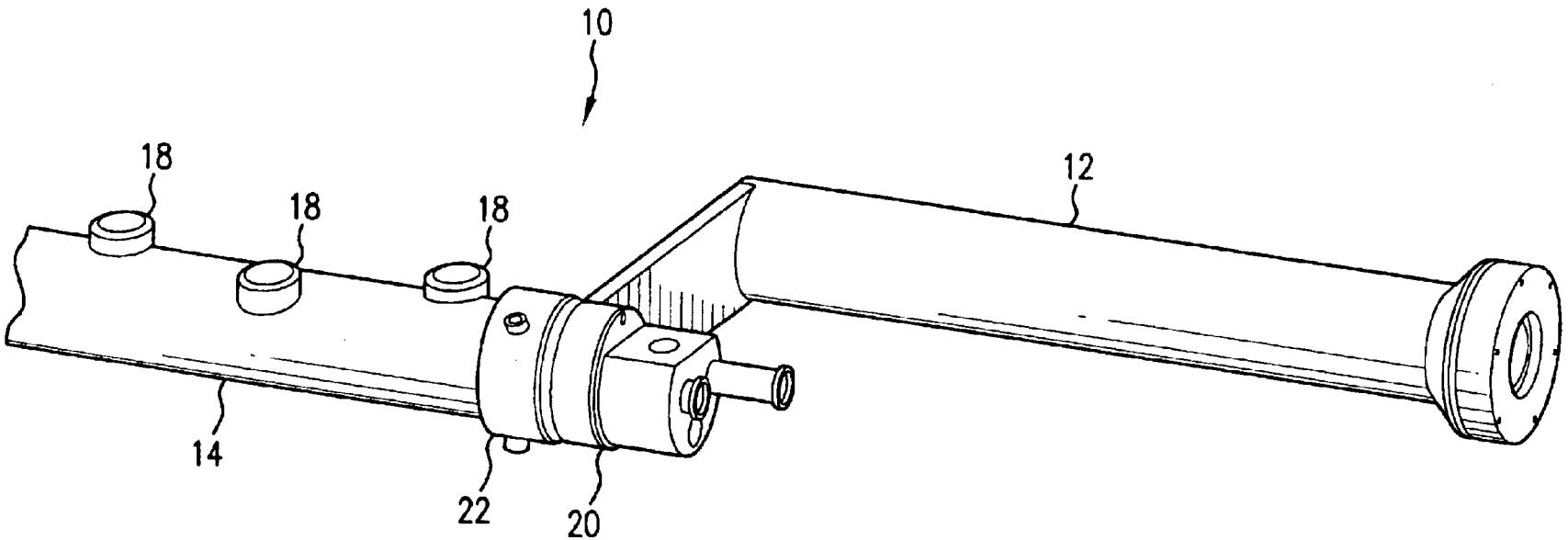
FIG. 1 illustrates a perspective view of a first embodiment of the spray bar.
Figure 17:
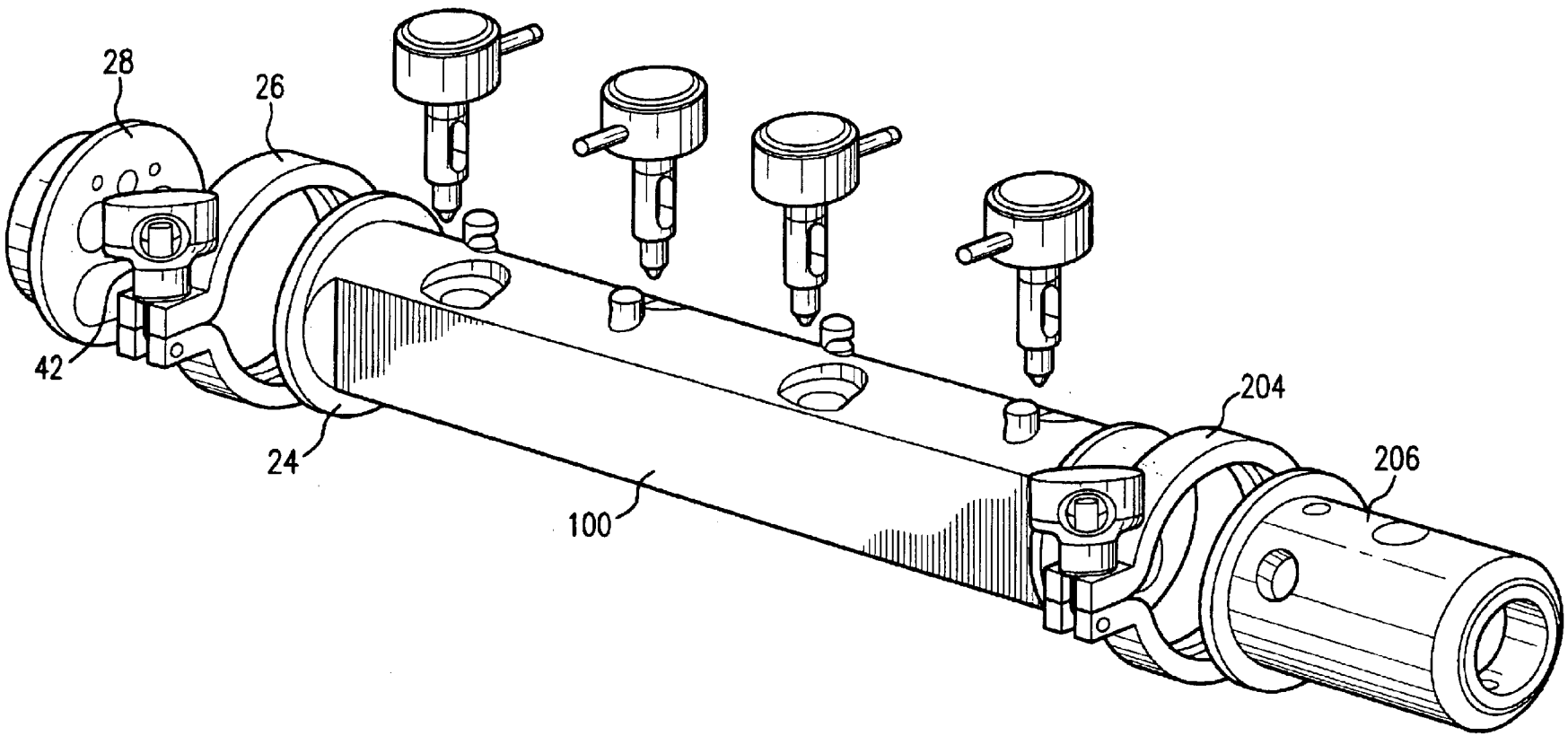
FIG. 17 shows a perspective view of a spray bar assembly.

FIGS. 1 through 8 illustrate a first preferred embodiment of the present invention. In FIG. 1, an isometric of an assembled spray bar 10 illustrating a first embodiment of the present invention is shown. A support arm 12 carries an assembled modular spray bar section 14 having four spray gun inserts 18 (three of which are shown in the drawing). The spray bar section 14 is locked to a connection hub 20 and the support arm 12 by threadless locking collars 22. The distal end of the spray bar 24 terminates in a second threadless locking collar 26 with an end cap 28 (FIG. 17). Preferably the spray bar 10 is constructed of a lightweight material, such as aluminum, titanium or even plastic. The gun assembly 18 can be constructed of stainless steel.

Figure 2:
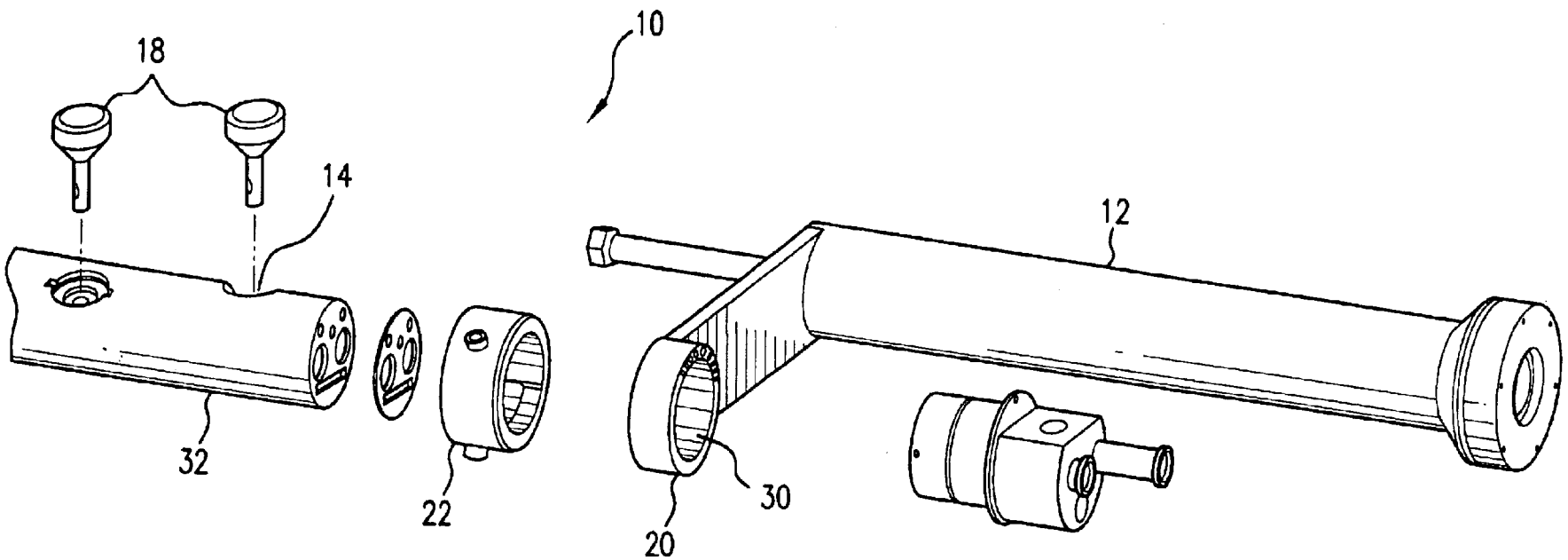
FIG. 2 illustrates an exploded view of the apparatus shown in FIG. 1.

In FIG. 2, an exploded view of the assembly 10 of FIG. 1 is shown. As illustrated in FIG. 2, one locking collar 22 couples the connection hub 20, which extends through a cylindrical opening 30 in the support arm 12, to an adjacent spray bar section 32, thereby locking the support arm 12, connection hub 20 and spray bar assembly 14 together as a substantially rigid unit.

Figure 5:
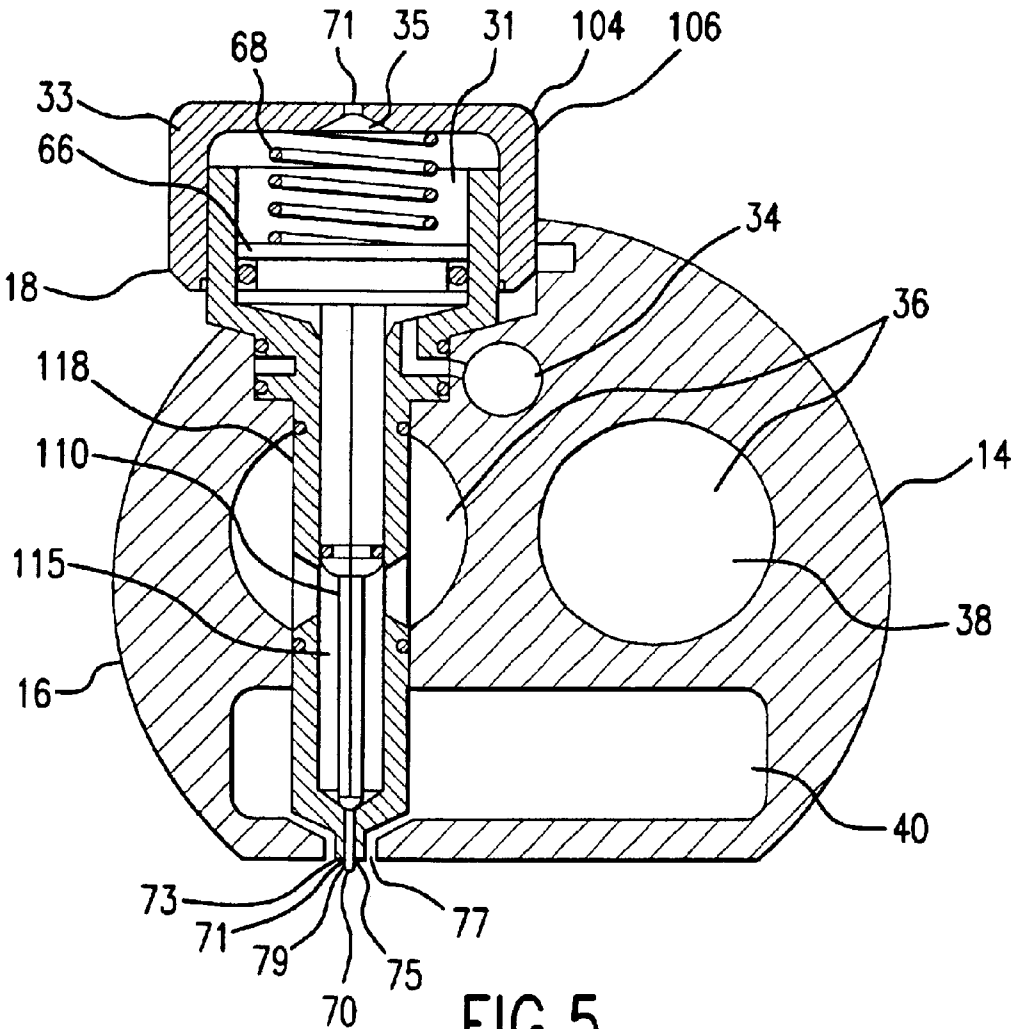
FIG. 5 illustrates a cross-sectional view of a spray bar section illustrating the gun insert assembly.

As further shown in FIG. 2 and in FIG. 5, the spray bar section 14 includes internally formed conduits or pathways 34 to supply piston air to drive the spray guns 18 to an open position, an inflow solution conduit 36 for injecting solution to be sprayed into the spray bar assembly 14 and a solution return conduit 38 for removing solution. Moreover, an atomizing air conduit 40 provides outflowing air to atomize the solution being ejected under pressure from the respective gun 18. Thus, the assembled spray bar 14 provides a single unitary structure with internal, sealed conduits. The gun inserts 18 are easily removed, from outside of the spray bar 10, for cleaning or replacement.

Referring briefly to FIG. 17, the spray bar section 14 is terminated and closed by a second locking collar 26. This collar 26 releasably engages a distal end 24 of the spray bar section 14 and is in turn closed by an end return element or cap 42.

Figure 3:
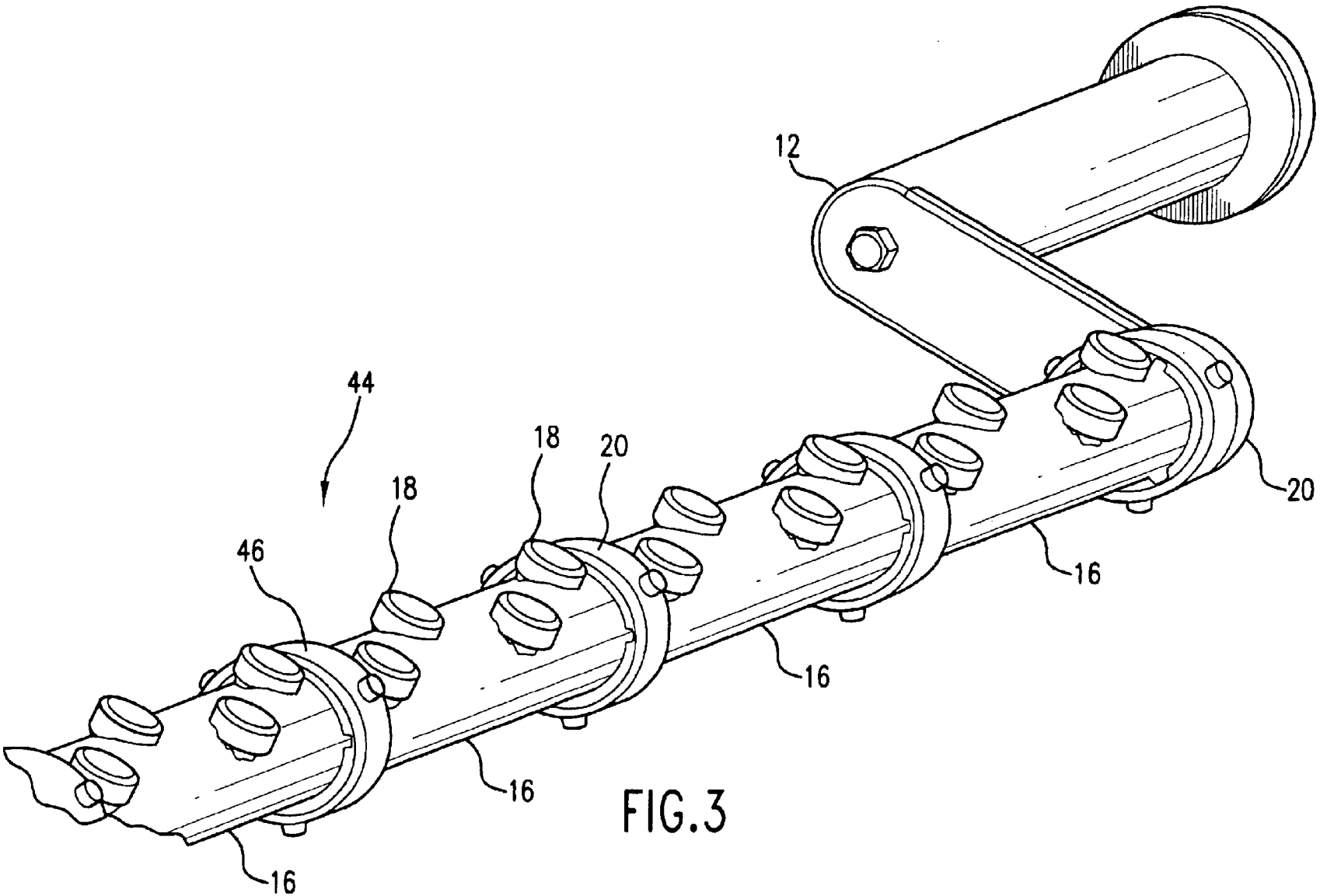
FIG. 3 illustrates a top plan view of an embodiment of the spray bar.

FIG. 3 illustrates a multi-section module assembly 44. The support arm 12 carries four identical spray bar sections 16, each of which is locked to an adjacent section 16 via an adjacent locking collar 46. The assembly of FIG. 3 can be readily dissembled into its constituent components. Each of the sections 16 can be readily separated from an adjacent locking collar 46 with a twisting motion.

Figure 4:
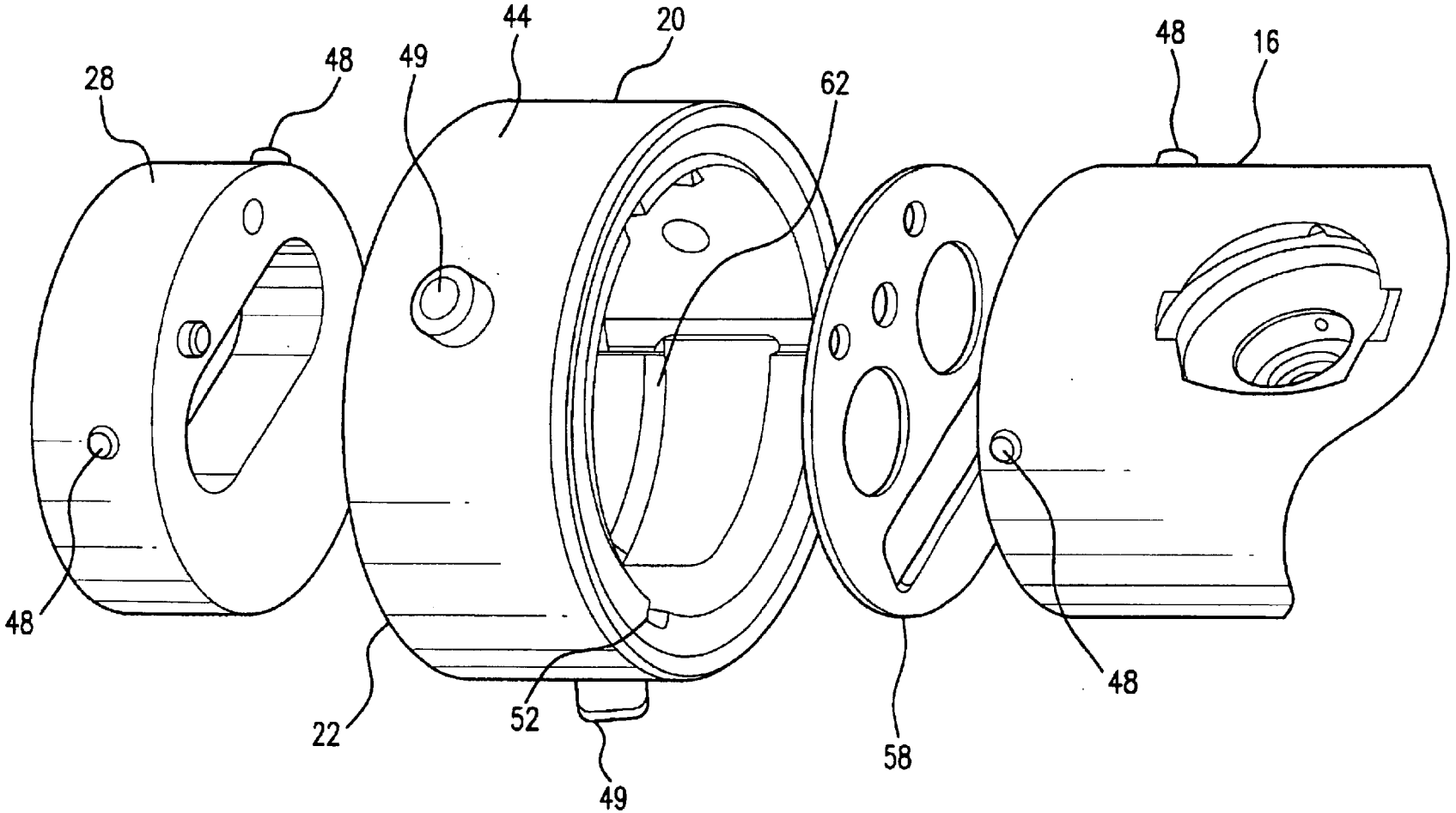
FIG. 4 illustrates an exploded view of a portion of the spray bar.

As shown in FIG. 4, additional details of the threadless releasible coupling mechanism of the assembly 44 are disclosed. Each of the spray bar sections 16 carries a plurality of radial locking pins 48, three in a preferred embodiment and at each end an axially oriented pin 50 and recess 52 for axial alignment. The radial pins 48 extend from an exterior peripheral cylindrical surface 54 of either an end cap 28 or a spray section 16 or the adapter hub 56. Similar radial locking pins 48 are carried on the end return element 58. The connection hub 20 also carries a set of three radial lock pins 49. The parts are aligned axially, namely one spray sections 16 with another (or an end cap or an adapter, respectively, with a spray section 16), each having a gasket or seal 58 between them by the axial pins 48 and recess 52.

The locking collar 22 carries a plurality of internally formed slots 62 through which the radial lock pins 48 slide prior to engaging respective tapered slots 64 carried within the locking collar 46. The locking collar 22 can be rotated after slidably engaging the radial lock pins 48 whereupon the radial lock pins 48 travel in the respective tapered slots 62 pulling the axially coupled parts together and compressing the gasket 58 to create a seal for the conduits 34. The radial lock pins 48 on the end return 28 engage corresponding internally formed tapered slots 62 in the locking collar 22.

FIG. 5 illustrates a sectional view of a spray bar section 16 illustrating the gun insert assembly 18. Four conduits, namely the atomizing air conduit 40, solution supply 36 and solution return 38 conduits and the piston air conduit 34 for driving the piston 66 and the gun 18 against the biasing spring 68 to open the solution discharge port 70 extend axially through each spray bar section 16. These conduits 34, 36, 38 and 40 are each in fluid communication with portions of the gun insert assembly 18, as follows.

The gun insert assembly 18 is provided with a cover 104 which secures the outer end 106 of the gun assembly 18 and affixes a shut-off spring 68 between the cover 104 and the piston and needle assembly 110 to effect movement of the needle assembly 110. Air from the piston air conduit 34 of the spray bar is communicated into the piston chamber 31 and moves the piston 66 upward against the biasing action of the spring 68. Air on the other side of the piston 66 exits the top of the spring housing 33 through a breathing hole 35 provided in the cover.

The piston and needle assembly 110 are connected so as to move together, and are moveable from a closed (lowered) position, as shown, to an open (raised) position by application of piston air. Movement of the piston 66 upward thereby moves the lower tip 71 of the needle 110 away from the seating surface 73 and permits fluid communication between the solution supply conduit 36 of the spray bar and the needle void 115 of the gun insert assembly 18, thus defining a passage 75 therebetween. A passage 77 provides constant fluid communication between the spray bar orifice 79 and the atomizing air conduit 40. The diameter of the orifice 79 thus provided can be varied in accordance with flow properties of the solution to be coated. Orifice diameters of 0.5 mm, 0.75 mm, 1.0 mm, 1.25 mm and 1.5 mm have been used with favorable results.

Thus, the needle assembly 110 is received in the spray bar orifice 79. Only the solution discharge port 70 is opened and closed by operation of the piston; the orifice itself remains open and communicative of atomizing air, thereby diminishing any fouling or bearding that may otherwise occur. Air pressure supplied to the atomization air generally is adapted to the viscosity of the coating; whereas 20 psi may be typical, higher air pressure can be in the range of 60 to 70 psi or higher.

Figure 6:
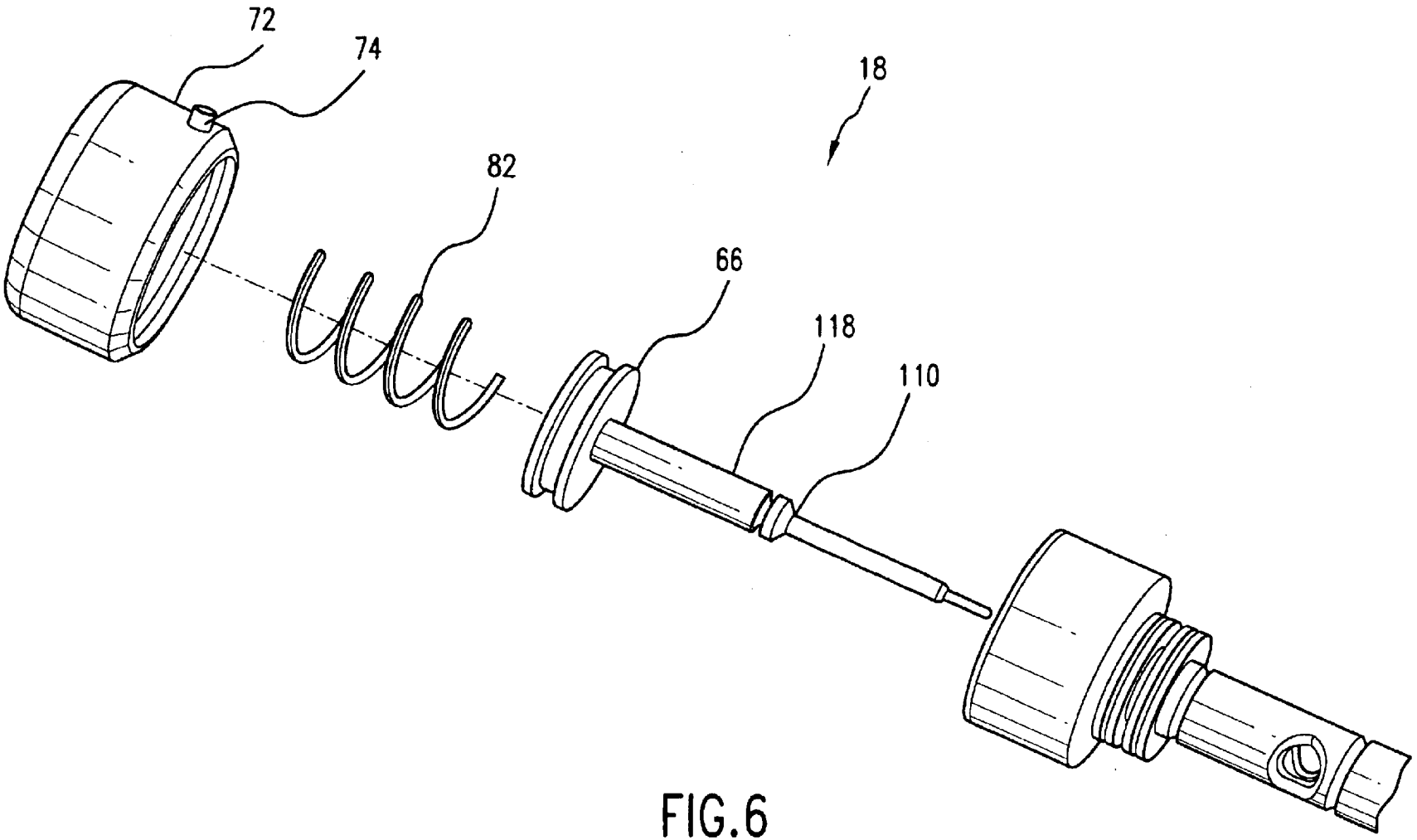
FIG. 6 illustrates further details of the gun assembly.
Figure 7:
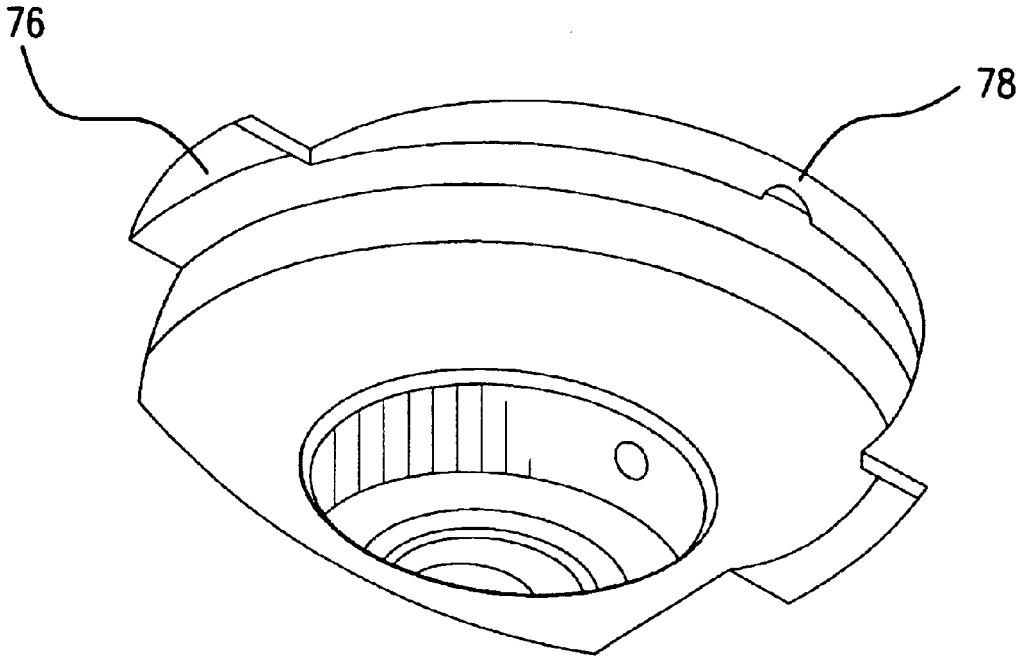
FIG. 7 illustrates a top plan perspective of a portion of the spray bar.

FIG. 6 illustrates further details of the gun assembly 18. The gun assembly 18 includes a gun cap 72 with a laterally extending locking pin 74 which can be used to rotatably lock the gun cap 72, and the remaining elements of the gun assembly 18 into the respective location in the spray bar section via a radial groove 76 and detent 78 (FIG. 7). Inserting the gun assembly elements into the gun port 80 in the spray bar section 16 illustrated in FIG. 11 and then rotating the gun cap 72 such that the locking pin 74 moves through the radial groove 76 into the detent 78 results in a cost effective, clean, retaining mechanism for the gun cap 72. Each gun assembly 18 includes a compression spring 82 which not only holds the gun 18 closed unless activated by air pressure but also locks the gun cap locking pin 74 to the bar section detent 78. Rotating the gun cap 72 in the reverse direction will release the locking pin 74 from the detent 78 for cleaning and maintenance purposes. When the cap 72 is released, the remaining elements of the gun assembly 18 can be extracted from the spray bar section 16 and readily replaced.

Figure 8:
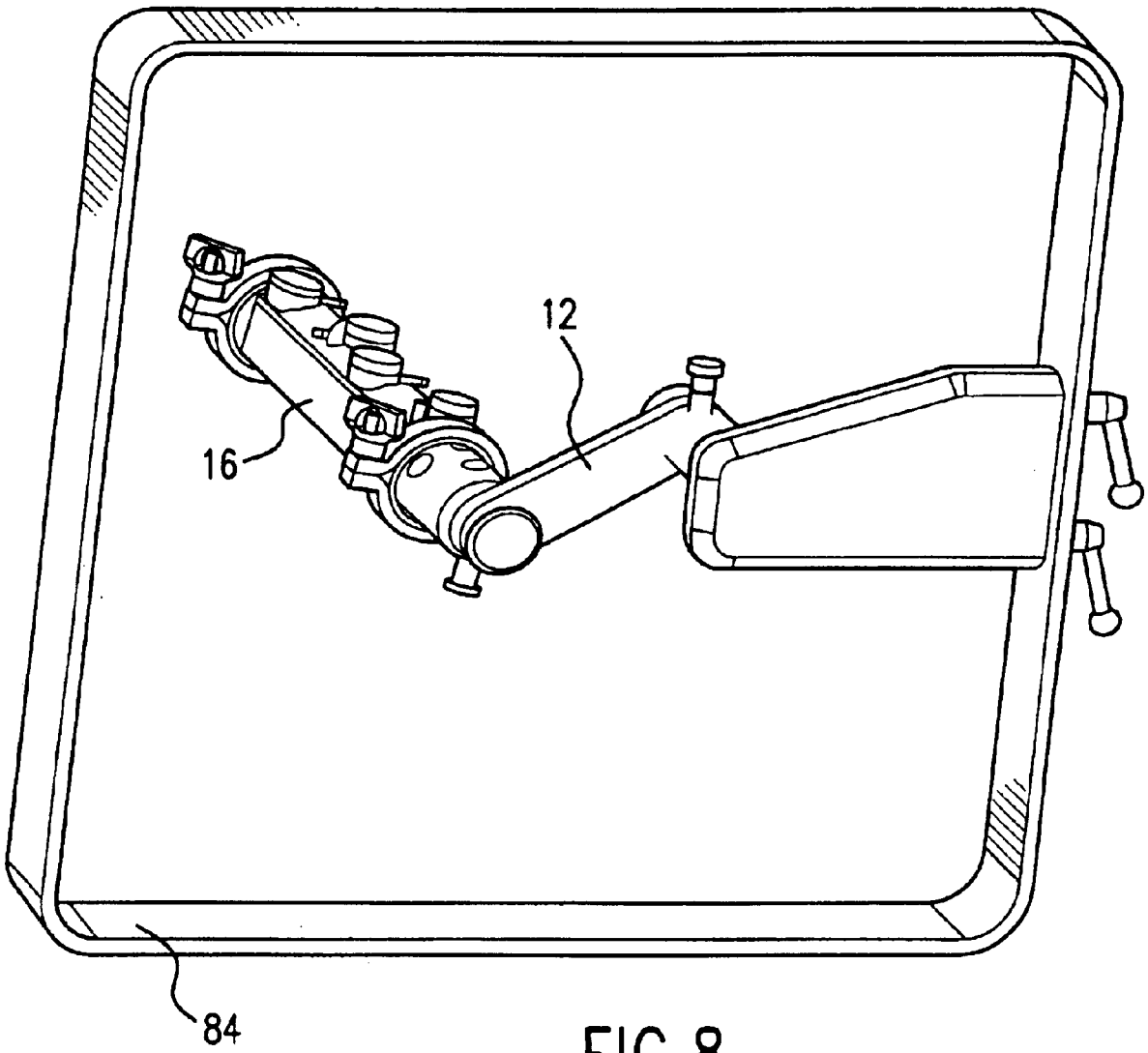
FIG. 8 illustrates an apparatus for using the spray bar in a coating application.

As shown in FIG. 8, the support arm 12 which can support one or more spray bar sections 16 (see FIGS. 1 and 3) can be carried on a movable, programmable cart 84. The cart 84 can be assembled to be insertable into a coating drum (not shown). Pre-stored programmed motions, provided by the cart mechanism to the support arm 12, move the spray bar sections 16 on the cart 84 within the drum, while the drum is rotating during the coating operation. The above-described assembly can be coupled to known carts and used to retrofit existing coaters with one or more spray bar sections. Alternately, the cart and supported spray bar sections can be combined with new coaters irrespective of the details of implementation of the coating unit.

Referring now to FIGS. 9 through 20, a second preferred embodiment 100 of the present invention is disclosed.

Figure 9:
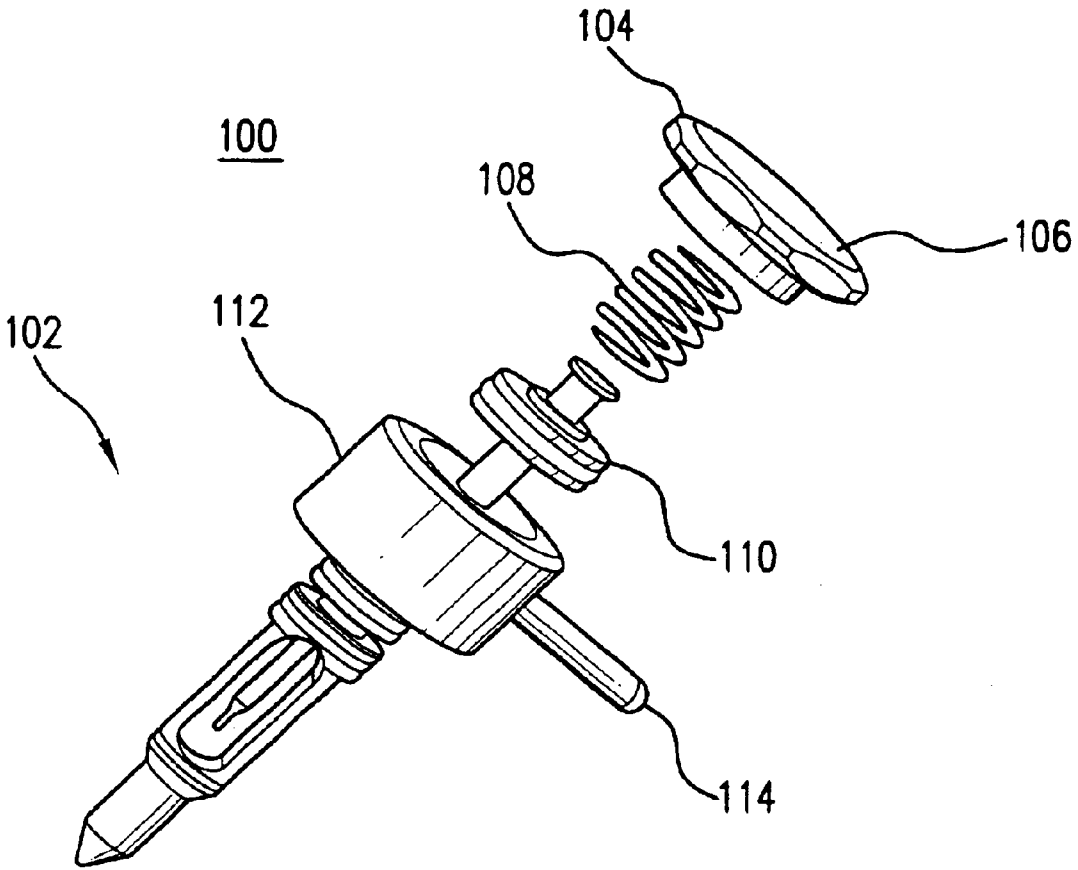
FIG. 9 illustrates an exploded view of a second embodiment of a spray gun assembly.
Figure 10:
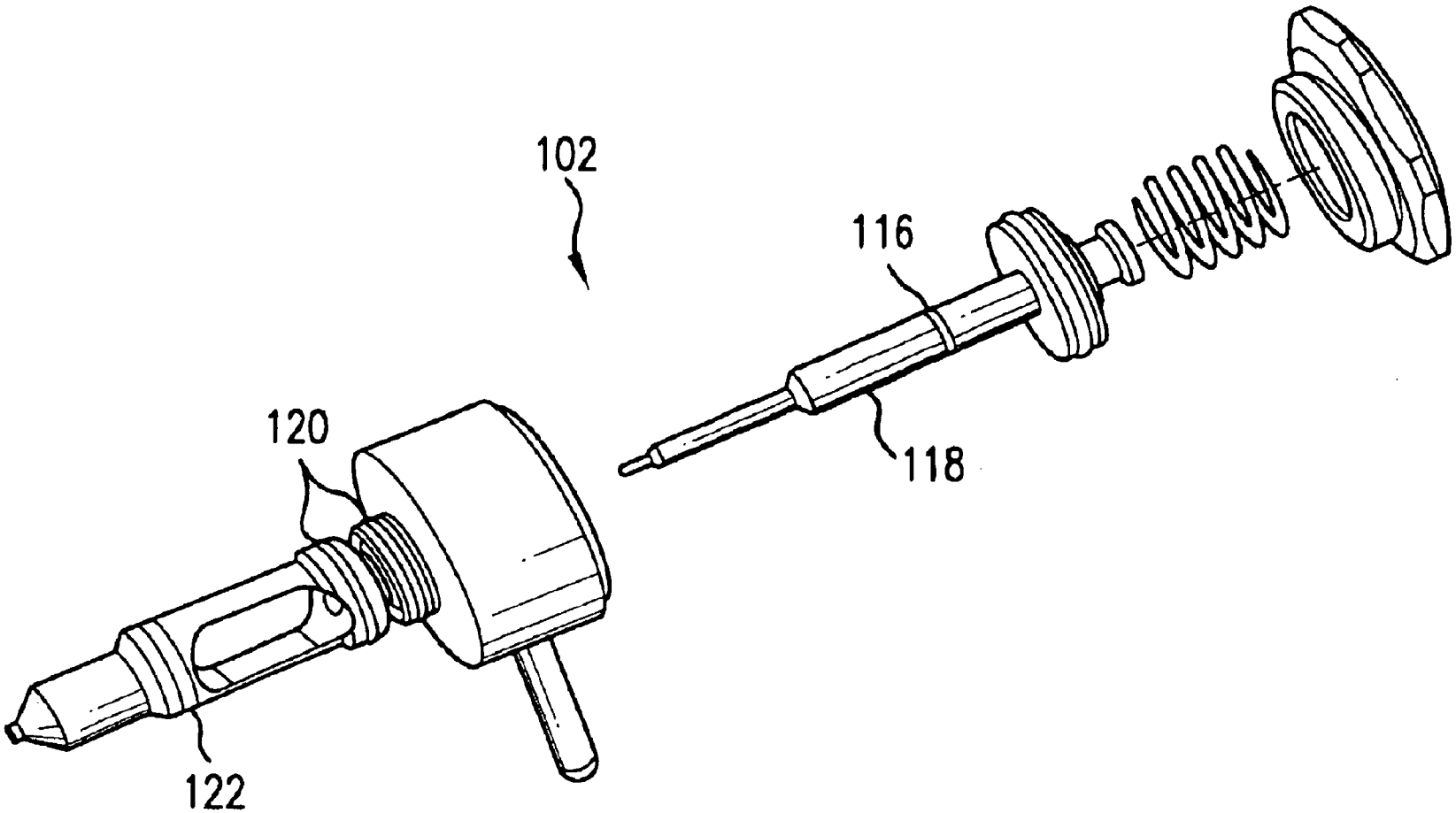
FIG. 10 illustrates an exploded view of a second embodiment of a spray gun assembly.

As can be seen in FIGS. 9 and 10, a partially exploded view of an alternative gun cartridge or gun subassembly 102 is shown. The gun assembly 102 is provided with a cover 104 which secures the outer end 106 of the gun assembly 102 and affixes a shut-off spring 108 between the cover 104 and the piston and needle assembly 110 to effect movement of the needle assembly 110. The piston and needle assembly 110 is received in a body insert assembly 112 which is provided with an outwardly disposed removal handle 114. The piston and needle assembly 110 has a shut-off needle O-ring 116 on an upper enlarged needle portion 118. The body insert assembly 112 is provided with a pair of body upper O-rings 120 and a body lower O-ring 122 which further provide sealing of the gun assembly 102 within a housing cylinder 80 of a spray bar 16 (FIG. 11).

Figure 11:
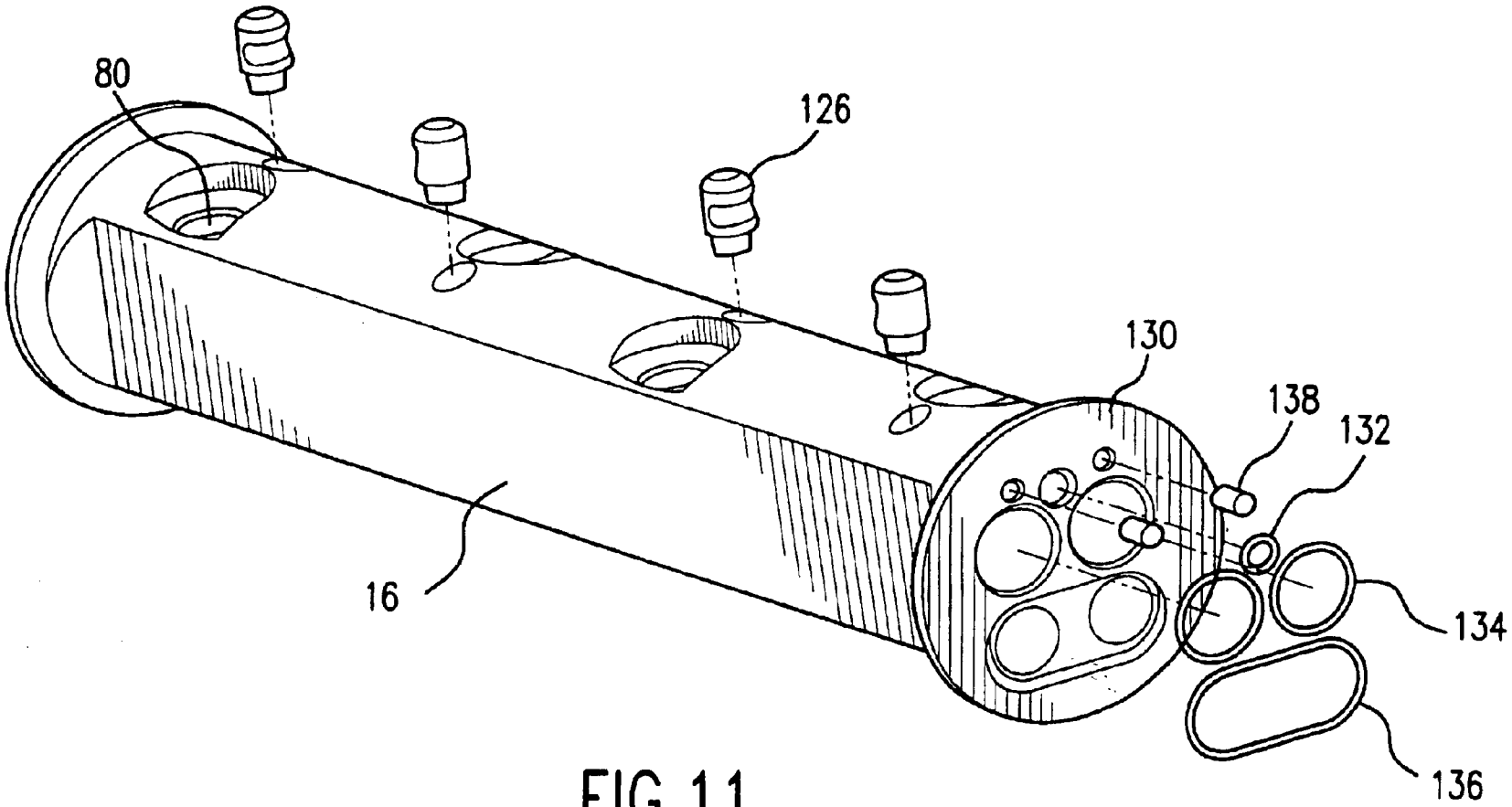
FIG. 11 illustrates a top plan view of a second embodiment of a spray bar.
Figure 12:
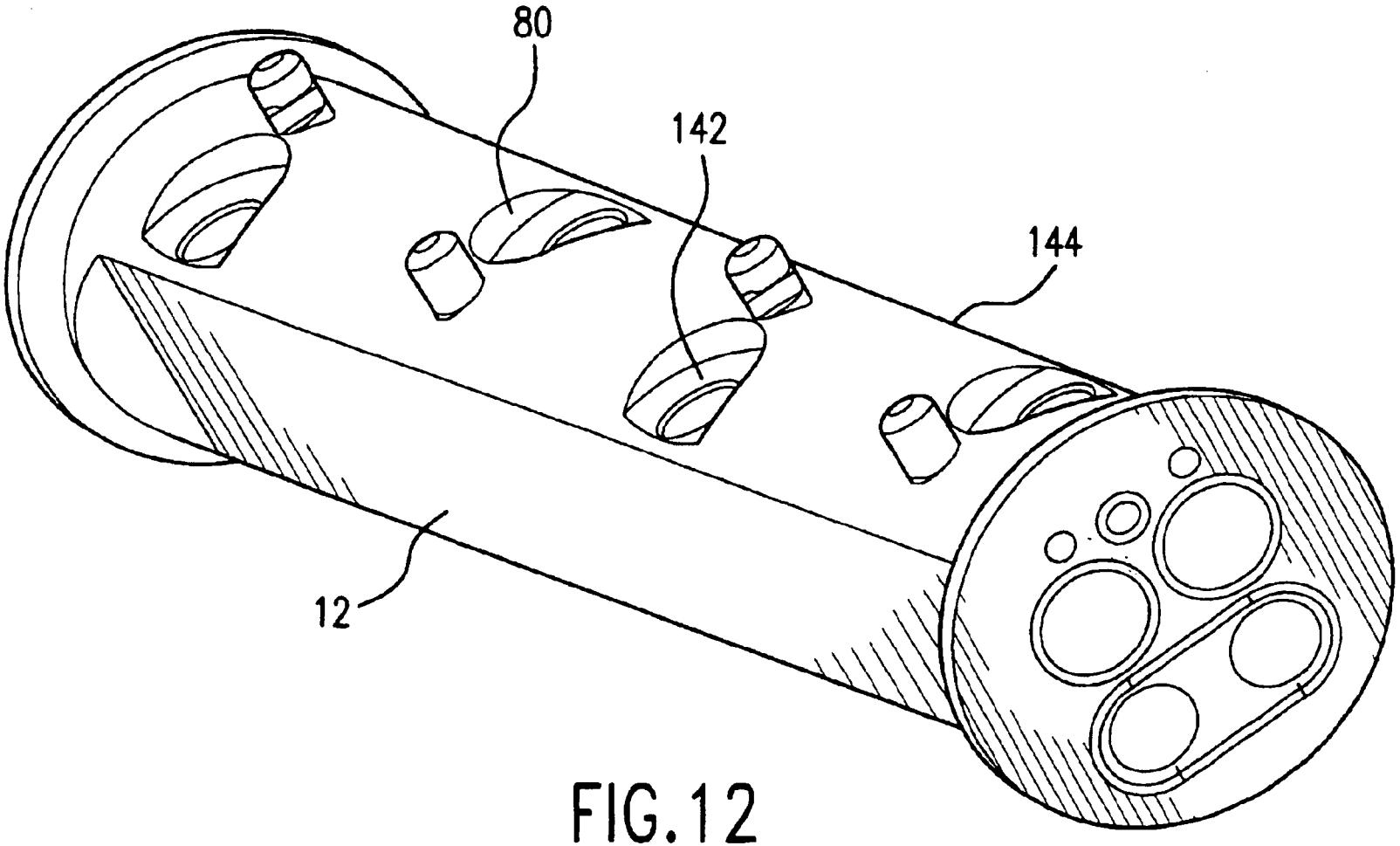
FIG. 12 illustrates a top plan view of a second embodiment of a spray bar.

As shown in FIG. 11, the spray bar assembly 16 is constructed and arranged to receive four gun cartridges (not shown). Lock posts 126 are provided to stop the rotational movement of the gun cartridge within the gun receiving orifice 80 by providing a stop position against which the removal handle abuts. Thus, disassembly and reassembly of the equipment results in repeatable reassembly without undue skill, thereby effecting better quality of product and more reliable production. The spray bar thus has a fluid connecting face 130 which can be aligned with a hub (FIG. 13) to effect fluid communication through the spray bar assembly 16. O-rings provide seals for the fluid communication, and comprise a piston air O-ring 132, solution delivery O-rings 134, and an atomizing air O-ring 136. Alignment pins 138 facilitate proper alignment of the spray bar 16 with the hub (not shown). As more clearly shown in FIG. 12, the spray bar 12 provides gun insert receptacles 80 that have a flattened face plate 142 recessed into the spray bar body 144.

Figure 13:
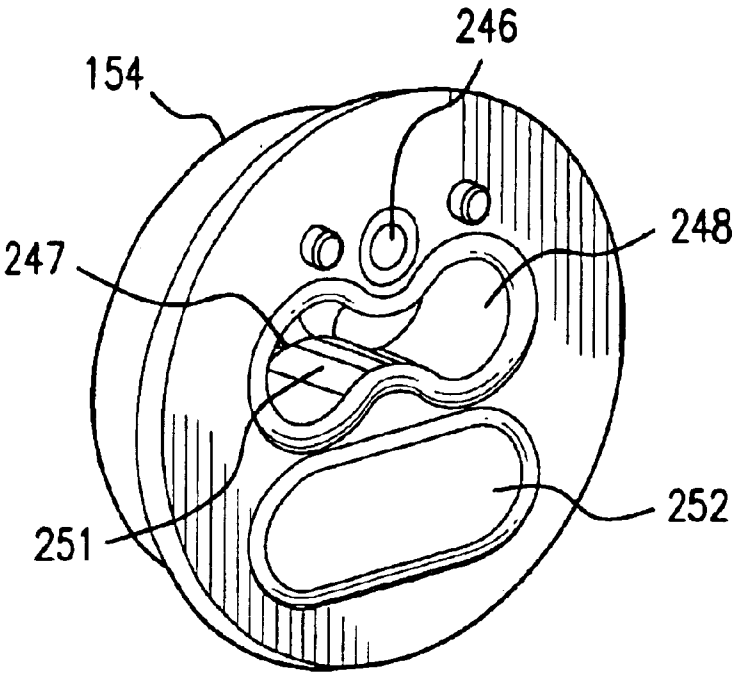
FIG. 13 illustrates a top plan view of a second embodiment of a portion of a spray bar.
Figure 13:
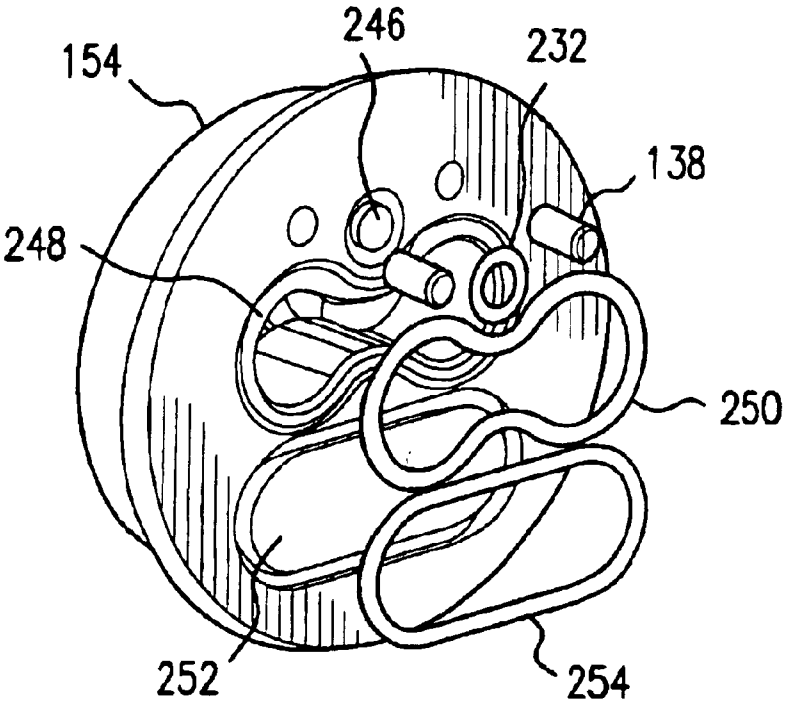

FIG. 13 illustrates the end return hub 154. The alignment pins 138 provide the alignment means for aligning the spray bar on the hub 154. Piston air is received into a piston air conduit 246 sealed by the piston air O-ring 232, such that further flow of the air is stopped at the hub 154. The solution supply conduit 247 and solution return conduit 248 are likewise sealed by an solution return O-ring 250, but the solution return cavity 251 in the hub 154 permits fluid communication between these, thus providing return of the solution. It is for this reason that the solution supply and return are interchangeable. The atomizing air conduit 252 is sealed by an atomizing air O-ring 254, thereby stopping flow of atomizing air past the hub 154.

Figure 14:
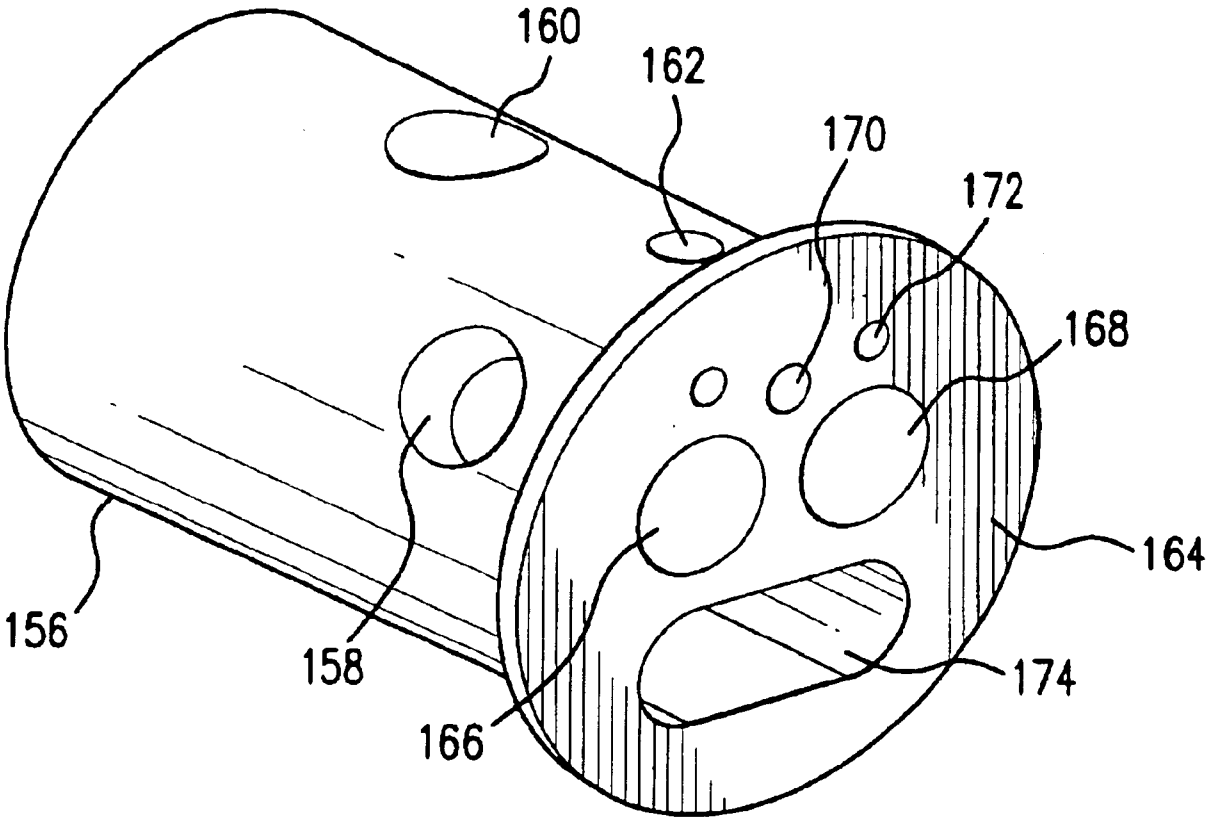
FIG. 14 illustrates a top plan view of a second embodiment of a portion of a spray bar.

FIG. 14 further illustrates the connection hub 156 for the spray bar. It is noted that the solution feed and solution return connections can be interchanged without effect of function or performance. As shown in the body portion 156 of the connection hub, an inlet orifice 158 provides connection to the solution feed. An inlet connection 160 for atomizing air is provided, as is an outlet (not shown). An inlet 162 for piston air is also provided. The face 164 of the connection hub is provided with a solution feed conduit 166, a solution return conduit 168 and a piston air conduit 170. Alignment holes 172 are constructed and arranged to receive the alignment pins (not shown). An atomizing air conduit 174 is further provided.

Figure 15:
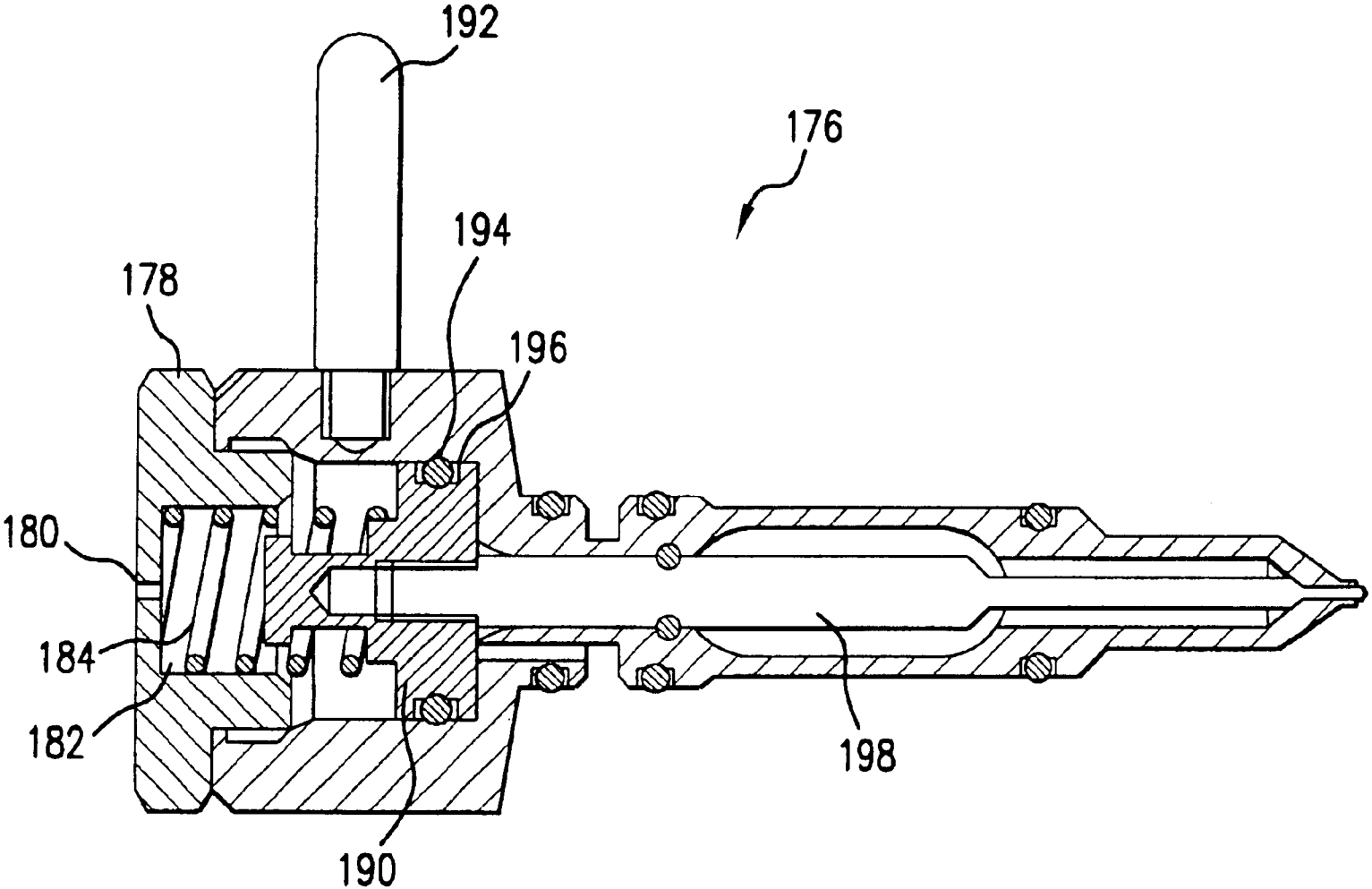
FIG. 15 illustrates a cross-sectional view of a second embodiment of a spray gun assembly taken along a plane intersecting the axis of the spray gun.

As shown in FIG. 15, a spray gun assembly 176 is shown. A cap 178 is provided with an air vent hole 180 centrally positioned therein and a spring housing cavity 182 to receive a needle shut-off compression spring 184. The cap 178 is received and secured to the gun body insert 188 by a threaded connection 190. The gun body insert contains a piston 190 and is provided with an outwardly projecting lock handle 192. Piston air O-ring seals 194 are received in ring grooves 196 positioned on the piston 190. A shut-off needle 198 extends inwardly into the gun assembly (not shown) such that movement of the needle 198 effects stoppage of the fluid flow, thus controlling the extent to which the spray bar assembly 176 effects coating of a material to be coated.

Figure 16:
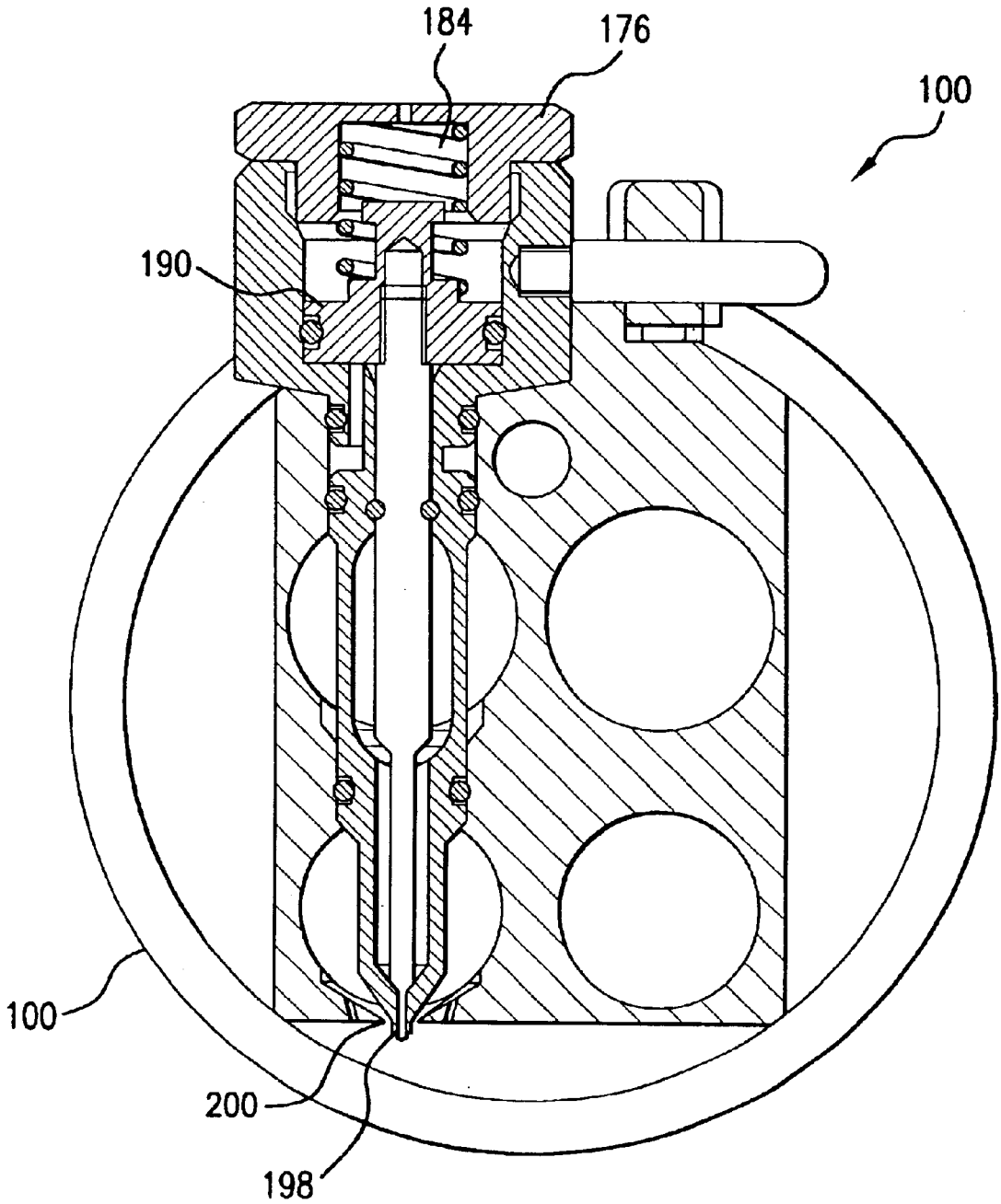
FIG. 16 illustrates a cross-sectional view of a second embodiment of a spray gun assembly taken along a plane perpendicular to the axis of the spray gun.

FIG. 16 illustrates the gun insert assembly 176 from a cross-sectional view take along a plane perpendicular to the axis of the gun. The gun assembly 176 is received in the spray bar section 100. The needle 198 is seated on an atomizing air exit annulus 200. As shown, the piston 190 is in the shut-off position, as the spring 184 returns downward until piston air is activated. Upon activation of the piston air, the spring 184 is compressed and the needle 198 retracts upward, thereby opening the solution exit orifice 202 and permitting coating of a material to be coated. Thus, the needle 198 is moveable between a closed position and an open position.

Figure 18:
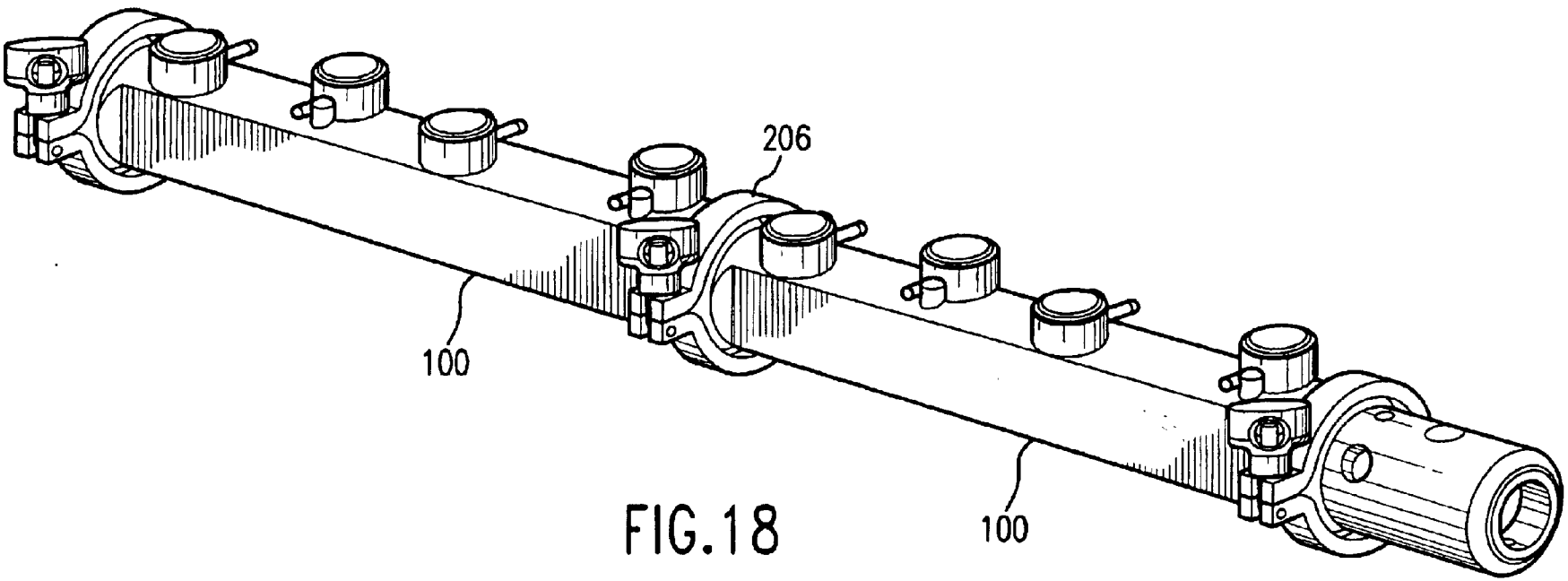
FIG. 18 shows a perspective view of a spray bar assembly.

FIG. 17 shows a perspective view of the spray bar assembly 100. A sanitary, commercially available clamp 204 secures the spray bar assembly 100 to the connection hub 206. In FIG. 18, two sections are shown assembled together.

Figure 19:
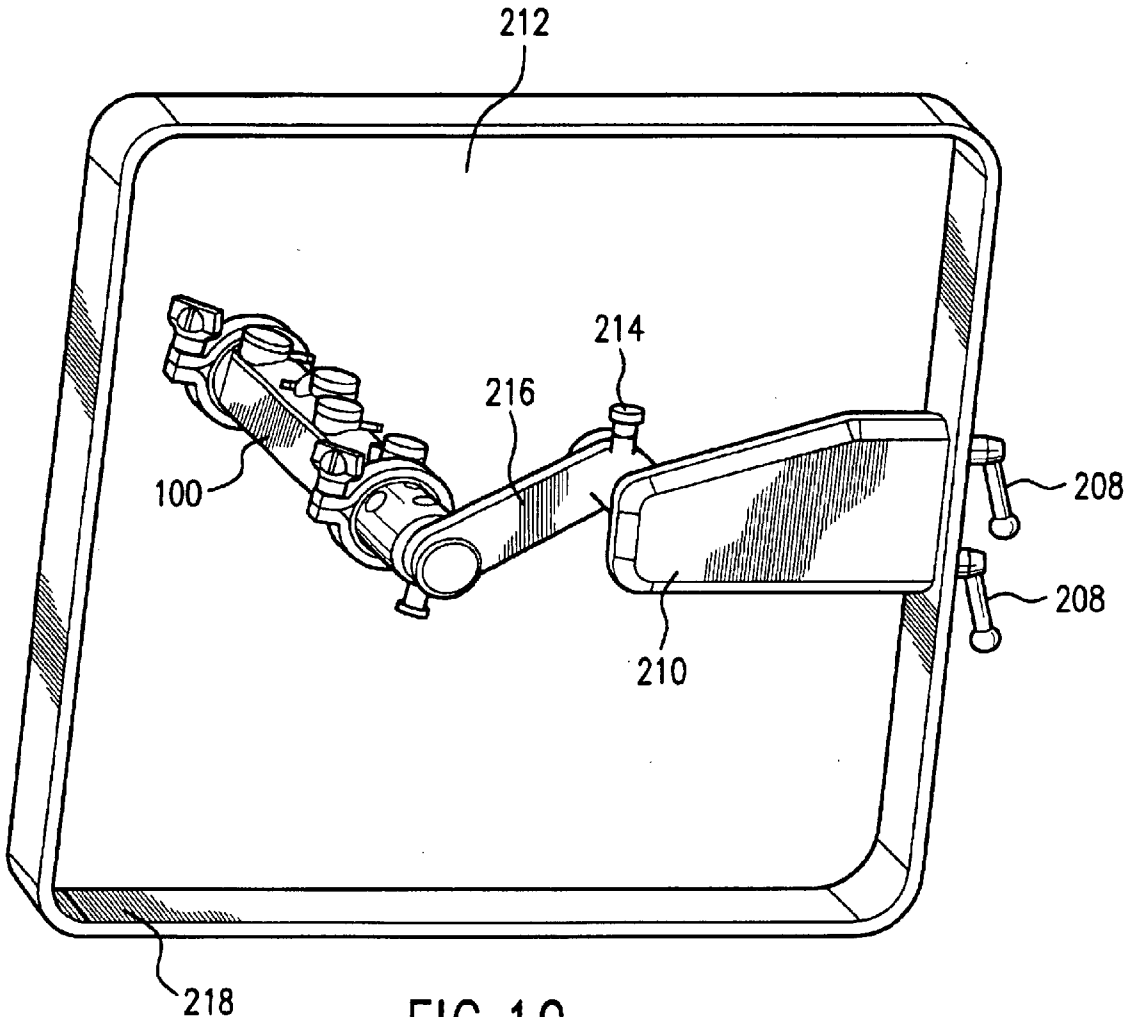
FIG. 19 illustrates an apparatus for using the spray bar in a coating application.
Figure 20:
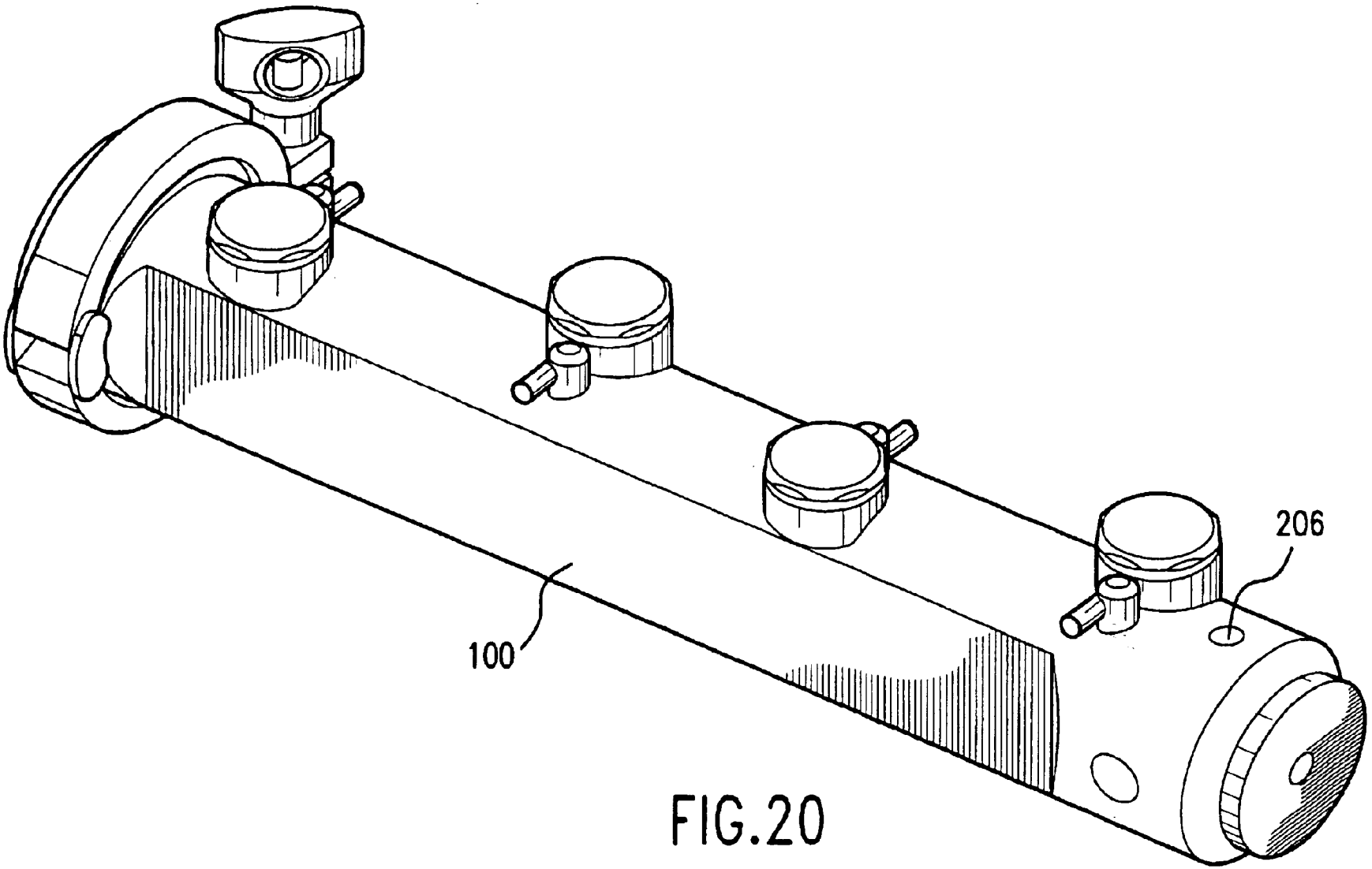
FIG. 20 illustrates a perspective view of another embodiment of a spray bar assembly.

FIG. 19 then shows attachment hardware for existing and new coating apparatus, illustrating the positioning of the spray bar 100 within a coating apparatus, such as a drum (not shown). Arm attachment levers 208 fix a support arm 210 in place, fixed centrally within a space 212 constructed and arranged to receive a material to be coated. An upper index plunger 214 provides support and an adjustment arm 216 is provided, shown here having a length of six inches. Adjustment arms 216 are provided for relative rotation of the spray bar 100 position within the space 212. As illustrated, the apparatus is positioned on a spray door collar 218, which provides a frame to the door (not shown) providing access to the drum (not shown). FIG. 20 shows an alternate embodiment in which the connection hub 206 is integral to the spray bar 100.

Figure 21:
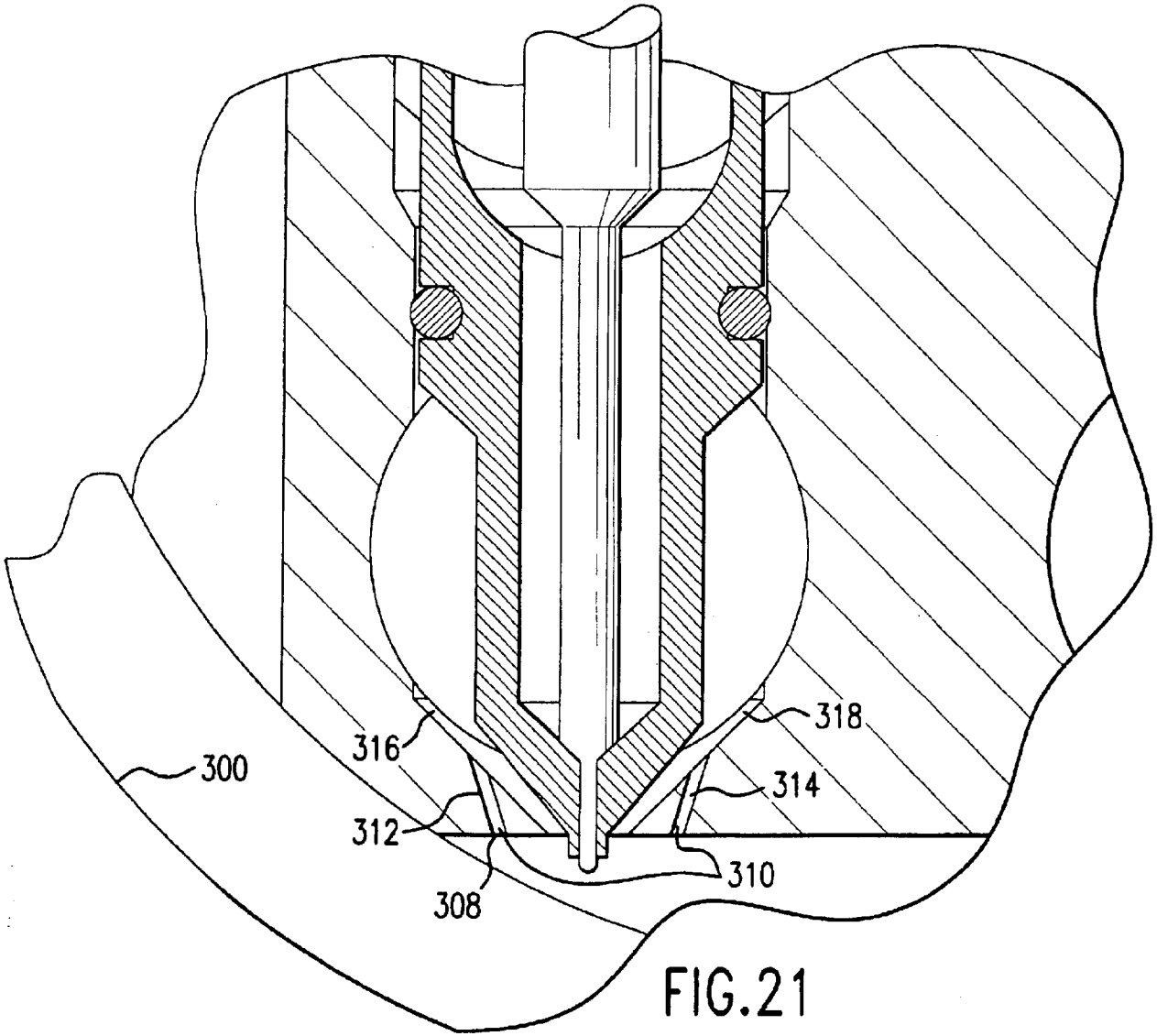
FIG. 21 illustrates a perspective view of another embodiment of a portion of a spray bar assembly.

As shown in FIG. 21, a modification to the spray bar 300 facilitates distorting or flattening the conical spray pattern of the coating spray. Side atomizing vents 308, 310 are provided by drilling or machining passages 312, 314 equidistant from the coating orifice and being in fluid communication with the atomizing air supply 316, 318. Thus, as the coating is projected outwardly, it is impacted by air streams to the sides, thereby flattening the conical spray pattern that would otherwise project into an oval shaped, more flattened pattern. The oval's great axis would be expected to be perpendicular to the imaginary line connecting the side atomizing vents 308, 310. It can be seen that varying the shape, angle and other parameters of the atomizing vents 308, 310 would be expected to produce differing results in the shape of the spray pattern from the orifice. Note particularly that a flattened spray pattern may be advantageous in some applications where greater coverage is desired, whereas a conical shape may be more advantageous in preventing fouling, or bearding, of the spray.

Figure 22:
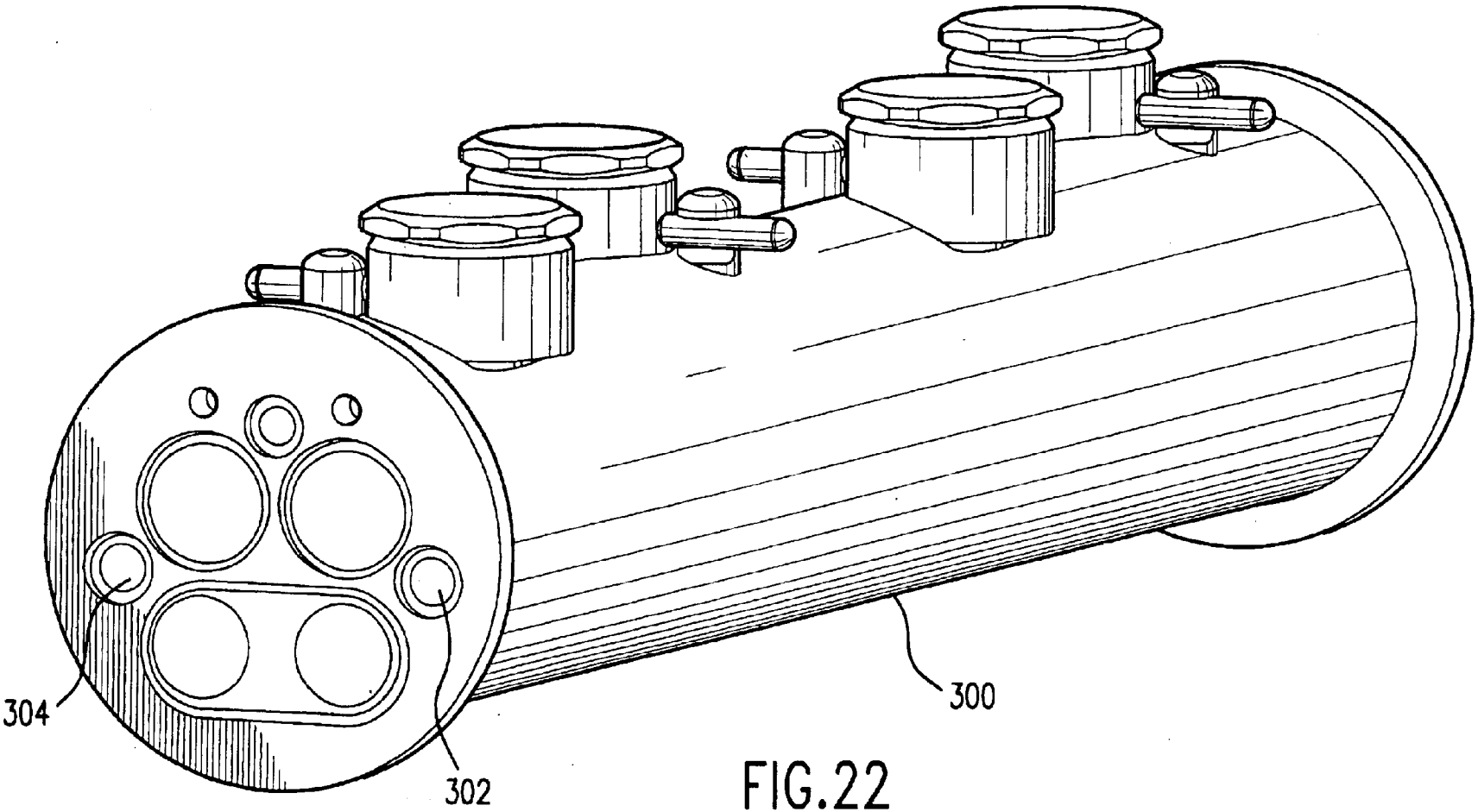
FIG. 22 illustrates a perspective view of another embodiment of a portion of a spray bar assembly.

As shown in FIG. 22, a variation in the spray bar assembly is shown. In contrast to the spray bar shown in earlier drawings, which is machined to have flat sides, the spray bar 300 shown in FIG. 22 retains a generally cylindrical shape. Heat exchanging fluid supply 302 and return holes 304 are provided extending axially down the sides of the spray bar 300. A heat exchanging fluid is provided in the supply hole 302 and is returned via the return hole 304. The end cap (not shown) is modified to provide fluid communication between the supply 302 and return 304 by providing a heat exchange fluid return cavity in similar fashion to the provision of fluid communication between the solution supply and return by the solution return cavity. It is understood that the heat exchanging fluid can either heat the spray bar or cool it.

Figure 23:
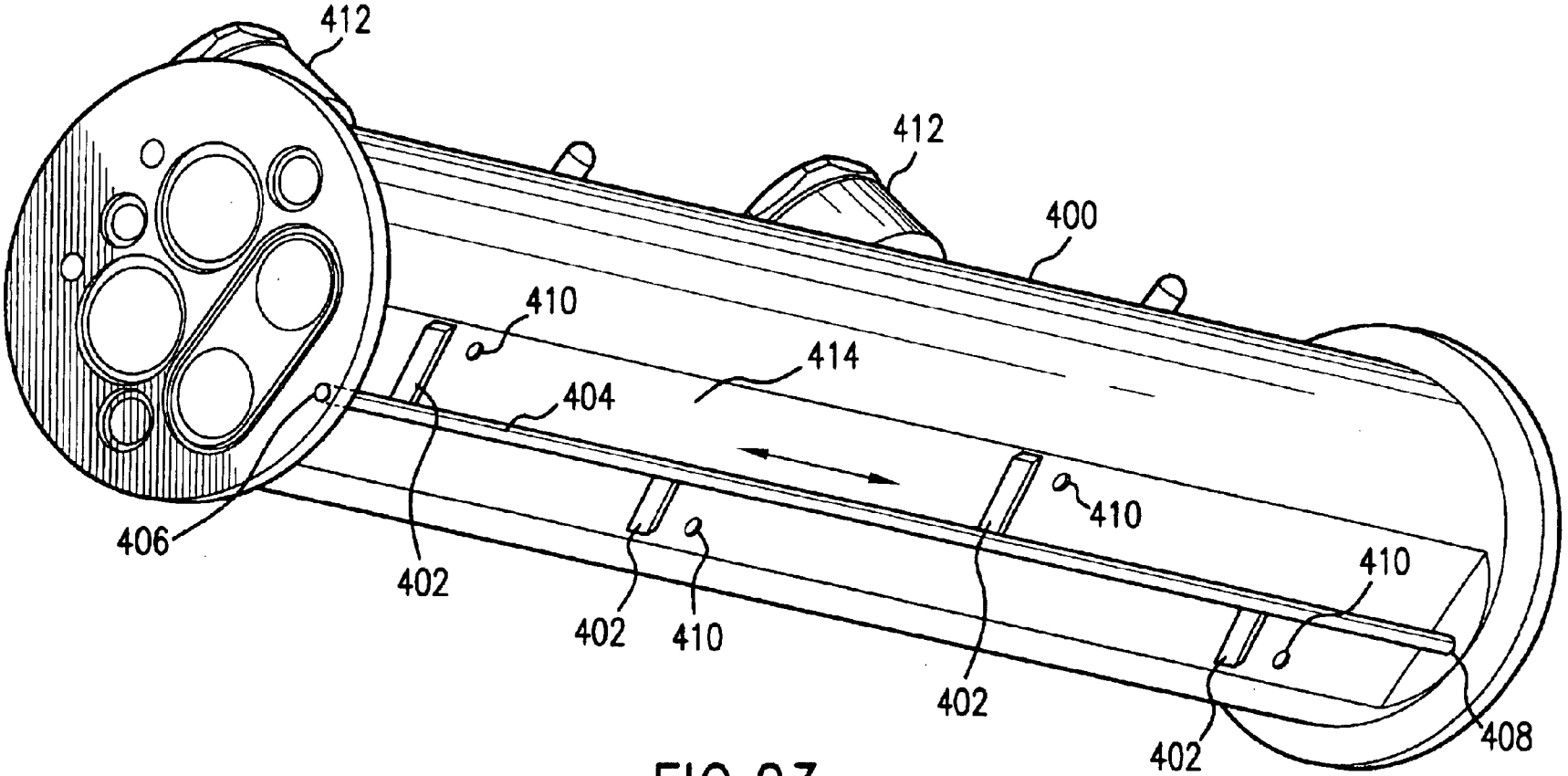
FIG. 23 illustrates a perspective view of another embodiment of a portion of a spray bar assembly.

As shown in FIG. 23, another embodiment of the spray bar 400 is disclosed and viewed from the bottom plan view. In this embodiment, cleaning sweeps 402 are provided, which can be operable either automatically or manually. The cleaning sweeps 402 are mounted on a track 404 held to the spray bar 400 by positioning stops 406, 408 positioned proximate to the orifices 410 associated with the spray guns 412, and are constructed and arranged to be in close contact with the flat bottom surface 414 of the spray bar 400. Upon activation, the sweeps 402 travel a predetermined distance across and beyond the orifice 410, preferably without losing contact with the spray bar surface 414, and clean away any build-up of coating material or product.

Figure 24:
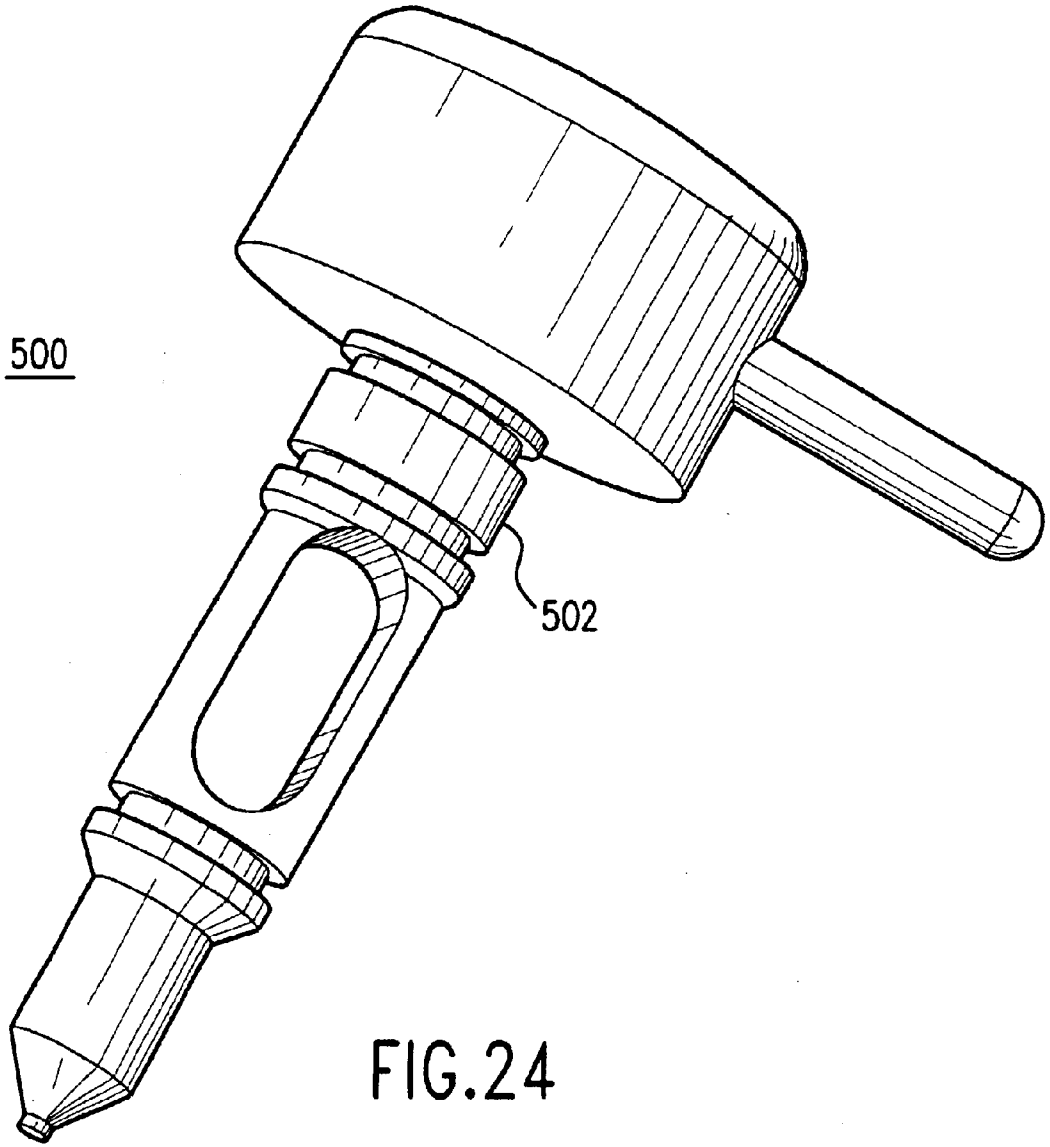
FIG. 24 illustrates a top plan view of an alternative gun assembly.

As shown in FIG. 24, another feature available to adapt the spray bar to multiple uses is the provision of a "dummy" gun assembly 500 rather than the operating gun assembly previously described. Such a dummy gun assembly 500 is made of a lightweight, easily worked material such as a plastic or vinyl, and lacks moving parts. Thus, in place of a piston and spring to effect movement of the needle portion from an open position to a closed position, the dummy gun as a solid body 502 and is constructed to be in the closed position at all times. Thus, no coating material can travel from the void through the orifice, and no coating takes place at a position where the dummy gun 500 is in place. The dummy gun 500 thus enables the user to shut off positions on the spray bar that are unnecessary to the particular application, thereby making the spray bar readily adaptable to a series of applications without requiring any design change to the spray bar.

Better and more uniform coating results from the embodiments thus described, as more gun assemblies can be utilized, and through the use of the dummy guns, selective distribution of working guns can be employed to afford non-overlapping spray patterns.

The preferred embodiments are thus adaptable to coating with a multitude of solutions or suspension, including those having relatively high viscosity, as high as 400 centipoise or perhaps higher, and suspensions having as much as 40 percent solids. For simplicity, throughout this application, Applicant has referred to solutions and suspensions as "solutions," and the text is to be understood as encompassing both. Additionally, temperatures during the coating process can be greater than 200 degrees Fahrenheit, although many pharmaceutical applications are conducted at room temperature.

A particular advantage to the preferred embodiments is that, as used with such difficult solutions, fouling is kept to a minimum and product quality is high, resulting in less discarded or disqualified product.

Another advantage to the design of the spray bar assembly as thus described is that it is modular. Thus, numerous spray bar assemblies can be connected to one another, thereby providing an operating length and gun assembly quantity to meet the specific needs of the user without require undue custom design of the coating apparatus.

Thus, a coating apparatus for coating a material to be coated with a solution is disclosed, preferably for coating pharmaceuticals. A spray bar having a spray gun receptacle, a solution inlet conduit and an atomizing air conduit is disclosed. The spray gun is positionable in the spray gun receptacle and has a body portion adapted to fit in the receptacle and an insertion portion having a sealable orifice at a spraying end thereof. The body portion has an internal void constructed and arranged to be in fluid communication with the solution inlet conduit and the atomizing air conduit when the spray gun is positioned in the spray gun receptacle and the insertion portion is in an open position. The insertion portion is moveable between an open position defining a passage between the body portion void and the spraying end orifice a closed position sealing the insertion portion against the body portion to close said passage.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. Apparatus for coating a material to be coated with a solution, the apparatus comprising, in combination:

a spray bar having a spray gun receptacle and having a solution inlet conduit and an atomizing air conduit;

a spray gun positionable in the spray gun receptacle and having a body portion adapted to fit in the receptacle and an insertion portion having a sealable orifice at a spraying end thereof, the body portion having an internal void constructed and arranged to be in fluid communication with the solution inlet conduit and the atomizing air conduit when the spray gun is positioned in the spray gun receptacle and the insertion portion is in an open position; and the insertion portion being moveable between an open position defining a passage between the body portion void and the spraying end orifice a closed position sealing the insertion portion against the body portion to close said passage.

2. An apparatus according to claim 1 in which the spray gun further comprises a piston received in the body portion, the piston operatively associated with the insertion portion to effect movement of the insertion portion between the open and closed position.

3. An apparatus according to claim 2 in which the insertion portion is biased to the closed position.

4. An apparatus according to claim 3 in which the spray bar further has a piston air supply conduit, the piston air supply conduit being in fluid communication with the piston when the spray gun is positioned in the spray gun receptacle, whereby air is provided through the piston air supply conduit at sufficient pressure to move the insertion portion from the closed position to the open position.

5. An apparatus according to claim 1 further comprising an radially extending handle on the body portion for rotating the body portion in the receptacle to effect insertion of the gun assembly in the spray bar.

6. An apparatus according to claim 5 further comprising a lock post positioned on the spray bar to provide a stop against which the radially extending handle of the spray gun will abut when the spray gun is fully inserted into the spray bar.

7. A spray gun subassembly comprising, in combination:

a spray gun subassembly constructed and arranged to be received in a spray gun receptacle having a solution inlet conduit and an atomizing air conduit;

the spray gun having a body portion adapted to fit in the receptacle and an insertion portion having a sealable orifice at a spraying end thereof, the body portion having an internal void constructed and arranged to be in fluid communication with the solution inlet conduit and the atomizing air conduit when the spray gun is positioned in the spray gun receptacle and the insertion portion is in an open position;

the insertion portion being moveable between an open position defining a passage between the body portion void and the spraying end orifice a closed position sealing the insertion portion against the body portion to close said passage;

the spray gun further having a piston received in the body portion, the piston operatively associated with the insertion portion to effect movement of the insertion portion between the open and closed position;

the insertion portion being biased to the closed position; and the spray bar further having a piston air supply conduit, the piston air supply conduit being in fluid communication with the piston when the spray gun is positioned in the spray gun receptacle, whereby air is provided through the piston air supply conduit at sufficient pressure to move the insertion portion from the closed position to the open position.

8. An apparatus according to claim 7 further comprising an radially extending handle on the body portion for rotating the body portion in the receptacle to effect insertion of the gun assembly in the spray bar.

9. An apparatus according to claim 8 further comprising a lock post positioned on the spray bar to provide a stop against which the radially extending handle of the spray gun will abut when the spray gun is fully inserted into the spray bar.

* * * * *